US009213274B2

(12) United States Patent
Kotaka et al.

(10) Patent No.: US 9,213,274 B2
(45) Date of Patent: Dec. 15, 2015

(54) GRINDING ROLLER, FIXING DEVICE, AND IMAGE FORMING APPARATUS

(71) Applicants: Kazuhiro Kotaka, Kanagawa (JP); Eiri Sagae, Kanagawa (JP); Satoshi Kai, Kanagawa (JP); Yoshihisa Hara, Kanagawa (JP); Yuusuke Arai, Kanagawa (JP)

(72) Inventors: Kazuhiro Kotaka, Kanagawa (JP); Eiri Sagae, Kanagawa (JP); Satoshi Kai, Kanagawa (JP); Yoshihisa Hara, Kanagawa (JP); Yuusuke Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/207,831

(22) Filed: Mar. 13, 2014

(65) Prior Publication Data

US 2014/0294455 A1 Oct. 2, 2014

(30) Foreign Application Priority Data

Mar. 29, 2013 (JP) ..... 2013-074184

(51) Int. Cl.
*G03G 15/00* (2006.01)
*G03G 15/20* (2006.01)

(52) U.S. Cl.
CPC ..... *G03G 15/2017* (2013.01); *G03G 15/2025* (2013.01); *G03G 2215/2032* (2013.01)

(58) Field of Classification Search
CPC ..... G03G 15/2017; G03G 15/2025; G03G 2215/2032
USPC ..... 451/36, 539
See application file for complete search history.

(56) References Cited

U.S. PATENT DOCUMENTS

| | | | | |
|---|---|---|---|---|
| 5,709,598 | A * | 1/1998 | Nishio et al. | 451/530 |
| 6,217,432 | B1 * | 4/2001 | Woo | 451/534 |
| 6,231,629 | B1 * | 5/2001 | Christianson et al. | 51/295 |
| 6,422,933 | B1 * | 7/2002 | Tintelnot | 451/526 |
| 7,430,392 | B2 * | 9/2008 | Ito et al. | 399/328 |
| 7,959,694 | B2 * | 6/2011 | Braunschweig et al. | 51/298 |
| 8,545,583 | B2 * | 10/2013 | Duescher | 51/298 |
| 2005/0185978 | A1 * | 8/2005 | Kemmochi | 399/69 |
| 2007/0054600 | A1 * | 3/2007 | Watanabe et al. | 451/36 |
| 2008/0038026 | A1 * | 2/2008 | Ai et al. | 399/328 |
| 2010/0255254 | A1 * | 10/2010 | Culler et al. | 428/143 |
| 2011/0244769 | A1 * | 10/2011 | David et al. | 451/539 |
| 2013/0164054 | A1 * | 6/2013 | Hayashi et al. | 399/329 |

FOREIGN PATENT DOCUMENTS

| | | |
|---|---|---|
| JP | 7-188429 | 7/1995 |
| JP | 10-506579 | 6/1998 |

(Continued)

*Primary Examiner* — Clayton E Laballe
*Assistant Examiner* — Trevor J Bervik
(74) *Attorney, Agent, or Firm* — Harness, Dickey & Pierce

(57) ABSTRACT

There is provided a grinding roller for use in a fixing device including a pair of rotary fixing members that rotate while being pressed against each other to form an area of contact, and heat and press a recording medium carrying an unfixed toner image and fed to the area of contact, to thereby fix the unfixed toner image on the recording medium. The grinding roller is configured to grind a surface of a toner image-side rotary member of the pair of rotary fixing members that comes into contact with the unfixed toner image. The grinding roller includes an abrasive grain layer including abrasive grains, forming a surface layer of the grinding roller, and having a surface with irregularities including projections each formed by an aggregate of some of the abrasive grains and larger in size than each of the abrasive grains and recesses formed between the projections.

7 Claims, 14 Drawing Sheets

(56) References Cited

FOREIGN PATENT DOCUMENTS

| | | |
|---|---|---|
| JP | 2004-082323 | 3/2004 |
| JP | 2005-349498 | 12/2005 |
| JP | 2005-349542 | 12/2005 |
| JP | 2006-136973 | 6/2006 |
| JP | 2007-073796 | 3/2007 |
| JP | 2008-040363 | 2/2008 |
| JP | 2008-040364 | 2/2008 |
| JP | 2008-221353 | 9/2008 |
| JP | 2008-268524 | 11/2008 |
| JP | 2008-268606 | 11/2008 |
| JP | 2009-512566 | 3/2009 |
| JP | 2009-229792 | 10/2009 |
| JP | 2009-535225 | 10/2009 |
| JP | 2010-179402 | 8/2010 |
| JP | 2011-507712 | 3/2011 |
| JP | 2011-123333 | 6/2011 |
| JP | 2012-515662 | 7/2012 |
| JP | 2012-208170 | 10/2012 |
| WO | WO96/10471 A1 | 4/1996 |
| WO | WO2007/047558 A1 | 4/2007 |
| WO | WO2007/127549 A2 | 11/2007 |
| WO | WO2009/085578 A2 | 7/2009 |
| WO | WO2010/085587 A1 | 7/2010 |

* cited by examiner

| | WITH IRREGULARITIES (Rsm: 78 μm) | WITHOUT IRREGULARITIES |
|---|---|---|
| BEFORE GRINDING |   |   |
| AFTER GRINDING (AFTER 30 GRINDINGS) |  |  |

| ABRASIVE GRAIN RATIO 60 %wt | ABRASIVE GRAIN RATIO 68 %wt | ABRASIVE GRAIN RATIO 80 %wt |
|---|---|---|
|   |  |   |
|   32-1 |   32-2 |   32-3 |

GRINDING ROLLER, FIXING DEVICE, AND IMAGE FORMING APPARATUS

CROSS-REFERENCE TO RELATED APPLICATION

This patent application is based on and claims priority pursuant to 35 U.S.C. §119(a) to Japanese Patent Application No. 2013-074184, filed on Mar. 29, 2013, in the Japan Patent Office, the entire disclosure of which is hereby incorporated by reference herein.

BACKGROUND

1. Technical Field

The present invention relates to a grinding roller that grinds a surface of a toner image-side rotary member that comes into contact with an unfixed toner image in a fixing device, a fixing device including the grinding roller, and an image forming apparatus including the fixing device.

2. Related Art

An electrophotographic image forming apparatus, such as a laser printer or a color image copier, normally forms an electrostatic latent image on the basis of image data input from a personal computer, an image input device, or the like, develops the electrostatic latent image with toner to form a toner image, transfers the toner image onto a recording medium such as a sheet, and fixes the transferred toner image on the recording medium with heat and pressure by using a fixing device.

The fixing device usually includes a pair of rotary fixing members that rotate while being pressed against each other to form an area of contact, and heat and press the recording medium carrying the unfixed toner image and fed to the area of contact, to thereby fix the unfixed toner image on the recording medium. The pair of rotary fixing members includes a toner image-side rotary member that comes into contact with the unfixed toner image, such as a fixing belt, for example.

If recording media of a given size are continuously fed through the pair of rotary fixing members (i.e., through the area of contact of the pair of rotary fixing members), streaks may be formed on portions of the rotary fixing members in contact with side edges of the recording media because the edges of the recording media may have so-called burrs from a cutting process in the manufacture of the recording media, and the streaks are in most cases due to damage on the surfaces of the rotary fixing members caused by such burrs. If the streaks are formed on the surface of the toner image-side rotary member, and if a recording medium wider than the recording media having caused the streaks is subjected to a fixing process using the toner image-side rotary member, the streaks may be transferred to the toner image on the wide recording medium, thereby degrading the image quality.

To address the above-described issue, the fixing device may include a grinding roller that grinds the surface of the toner image-side rotary member.

From the viewpoint of productivity in image formation of the image forming apparatus, it is desirable to reduce the grinding time of the grinding roller as much as possible. As a method for reducing the grinding time, it is conceivable to increase the particles size of the abrasive grains forming the grinding surface on the outer circumferential surface of the grinding roller to improve the grinding performance per unit time of the grinding roller having such a grinding surface. The increase in particle size of the abrasive grains forming the grinding surface, however, results in a reduction in glossiness of the ground surface of the rotary fixing member and thus a reduction in glossiness of the fixed toner image.

SUMMARY

The present invention provides an improved grinding roller for use in a fixing device including a pair of rotary fixing members that rotate while being pressed against each other to form an area of contact, and heat and press a recording medium carrying an unfixed toner image and fed to the area of contact, to thereby fix the unfixed toner image on the recording medium. The grinding roller is configured to grind a surface of a toner image-side rotary member of the pair of rotary fixing members that comes into contact with the unfixed toner image. The grinding roller includes, in one example, an abrasive grain layer including abrasive grains, forming a surface layer of the grinding roller, and having a surface with irregularities including projections recesses formed between the projections. Each of the projections is formed by an aggregate of some of the abrasive grains and larger in size than each of the abrasive grains.

The present invention further provides an improved fixing device that, in one example, includes a pair of rotary fixing members and the above-described grinding roller. The rotary fixing members are configured to rotate while being pressed against each other to form an area of contact, and heat and press a recording medium carrying an unfixed toner image and fed to the area of contact, to thereby fix the unfixed toner image on the recording medium.

The present invention further provides an improved image forming apparatus that, in one example, includes an image forming unit configured to form an unfixed toner image on a recording medium and the above-described fixing device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
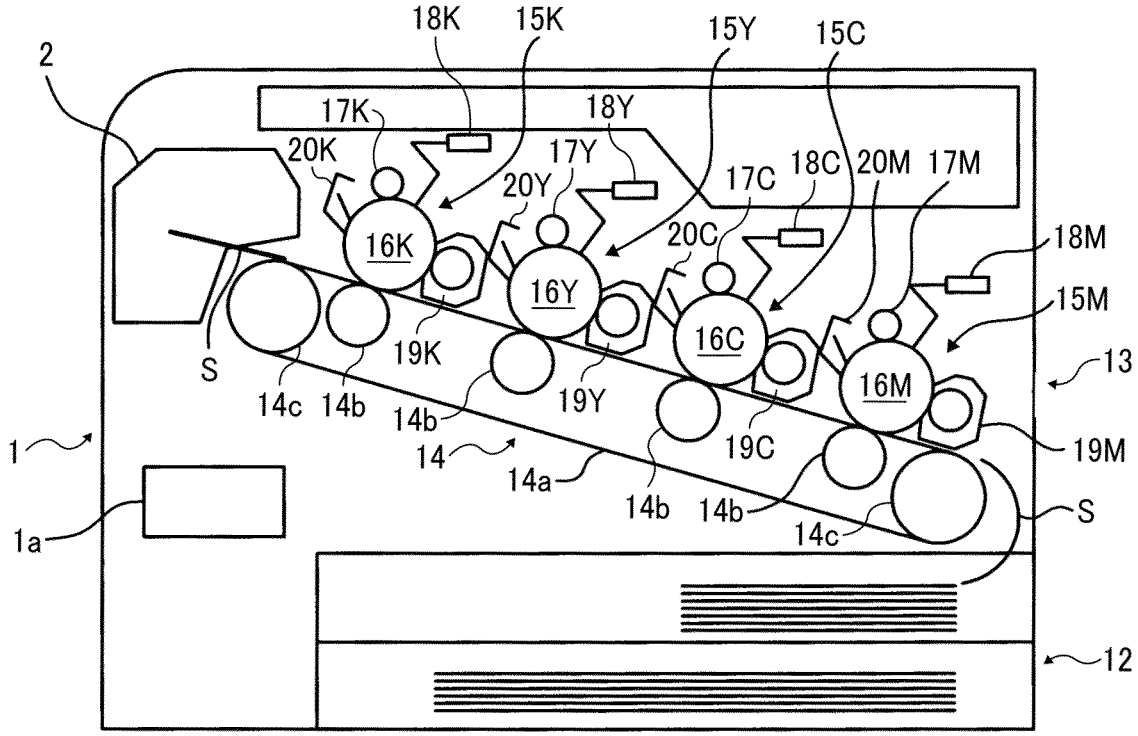
FIG. 1 is a diagram illustrating an overall configuration of an image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

Description will first be given of an overall configuration of an image forming apparatus according to an embodiment of the present invention. FIG. 1 is a diagram illustrating an overall configuration of an image forming apparatus 1 according to the present embodiment. The image forming apparatus 1 in FIG. 1 is a full-color printer including a sheet feeding unit 12 disposed in a lower part of the image forming apparatus 1, an image forming unit 13 disposed above the sheet feeding unit 12, and a controller 1*a* for controlling the operations of the image forming unit 13 and other units of the image forming apparatus 1.

The image forming apparatus 1 forms an image on a recording medium S fed from the sheet feeding unit 12. The recording medium S may be plain paper usually used for copying, an overhead projector (OHP) sheet, 90 k paper (i.e., a sheet with a size of 788 mm×1091 mm weighing 90 kg/1000 sheets), such as cards and postcards, and a special sheet larger in thermal capacity than plain paper, such as envelopes and thick paper having a basis weight of approximately 100 g/m$^2$ or more, for example.

The image forming unit 13 includes a transfer belt device 14, four image forming units 15M, 15C, 15Y, and 15K, and a fixing device 2.

The transfer belt device 14 is disposed at an angle, with a sheet feeding side (i.e., the right side in FIG. 1) thereof located below a sheet discharging side (i.e., the left side in FIG. 1) thereof. The transfer belt device 14 includes an endless transfer belt 14*a*, transfer rollers 14*b*, and tension rollers 14*c*. One of the tension rollers 14*c* is driven by a drive source (not illustrated) to rotate the transfer belt 14*a* wound around the tension rollers 14*c*.

On an upper portion of the transfer belt 14*a*, the image forming units 15M, 15C, 15Y, and 15K for magenta (M), cyan (C), yellow (Y), and black (K) colors are sequentially aligned from the upstream side in the rotation direction of the transfer belt 14*a*. The fixing device 2 is disposed downstream of the image forming unit 15K in the rotation direction of the transfer belt 14*a*. The image forming apparatus 1 in FIG. 1 is a so-called tandem color printer having the thus-aligned image forming units 15M, 15C, 15Y, and 15K.

The image forming units 15M, 15C, 15Y, and 15K include photoconductors 16M, 16C, 16Y, and 16K, charging rollers 17M, 17C, 17Y, and 17K, optical writing units 18M, 18C, 18Y, and 18K, development devices 19M, 19C, 19Y, and 19K, and cleaning devices 20M, 20C, 20Y, and 20K, respectively. Hereinafter, the suffixes M, C, Y, and K following reference numerals will be omitted where the distinction between the colors is unnecessary.

In each image forming unit 15, the photoconductor 16 serving as an image carrier is driven to rotate clockwise in FIG. 1 by a driving device (not illustrated). The photoconductor 16 is surrounded by the charging roller 17 serving as a charging device, the optical writing unit 18 that exposes the photoconductor 16 to a laser beam to write an image thereon, the development device 19, and the cleaning device 20.

In the image forming apparatus 1, the photoconductor 16M of the image forming unit 15M for the magenta color is first charged by the charging roller 17M. Then, the photoconductor 16M is exposed to the laser beam emitted from the optical writing unit 18M. Thereby, an electrostatic latent image is formed on the photoconductor 16M. The electrostatic latent image is then developed with toner by the development device 19M to be rendered visible as a magenta toner image. Meanwhile, a predetermined recording medium S is fed from the sheet feeding unit 12 onto the transfer belt 14*a*. With the rotation of the transfer belt 14*a*, the recording medium S reaches a transfer position facing the photoconductor 16M. At the transfer position, the magenta toner image is transferred onto the recording medium S by the corresponding transfer roller 14*b* provided on the inner circumferential surface of the transfer belt 14*a*.

The other image forming units 15C, 15Y, and 15K similarly form respective toner images, which are then sequentially superimposed on and transferred to the recording medium S fed by the transfer belt 14*a*.

The image forming unit 13 is an example of an image forming unit according to an embodiment of the present invention. In the present embodiment, the image forming unit 13 directly transfers the toner images from the photoconductors 16M, 16C, 16Y, and 16K onto the recording medium S. However, an image forming unit according to an embodiment of the present invention is not limited to the image forming unit 13 according to the present embodiment. For example, an image forming unit according to an embodiment of the present invention may first transfer the toner images from the photoconductors 16M, 16C, 16Y, and 16K onto an intermediate transfer member such as an intermediate transfer belt, and then transfer the toner images from the intermediate transfer member onto the recording medium S. In this case, the intermediate transfer member is included in the image forming unit according to an embodiment of the present invention.

The recording medium S subjected to the transfer process in all of the image forming units 15M, 15C, 15Y, and 15K is fed to the fixing device 2. In the fixing device 2, the toner adhering to the recording medium S is thermally fused and pressed to be fixed on the recording medium S. The recording medium S subjected to the fixing process is discharged to the outside of the image forming apparatus 1 through a discharge port (not illustrated).

In the present embodiment, a tandem color printer is described as an example of an image forming apparatus. However, an image forming apparatus according to an embodiment of the present invention is not limited to the tandem color printer, and may be a different type of image forming apparatus, such as a rotary-type image forming apparatus including a single photoconductor, for example. Further, an image forming apparatus according to an embodiment of the present invention may be a monochrome printer or an image forming apparatus other than the printer, such as a copier or a facsimile machine, for example.

Description will now be given of the configuration of the fixing device 2 included in the image forming apparatus 1 in FIG. 1.

Figure 2B:
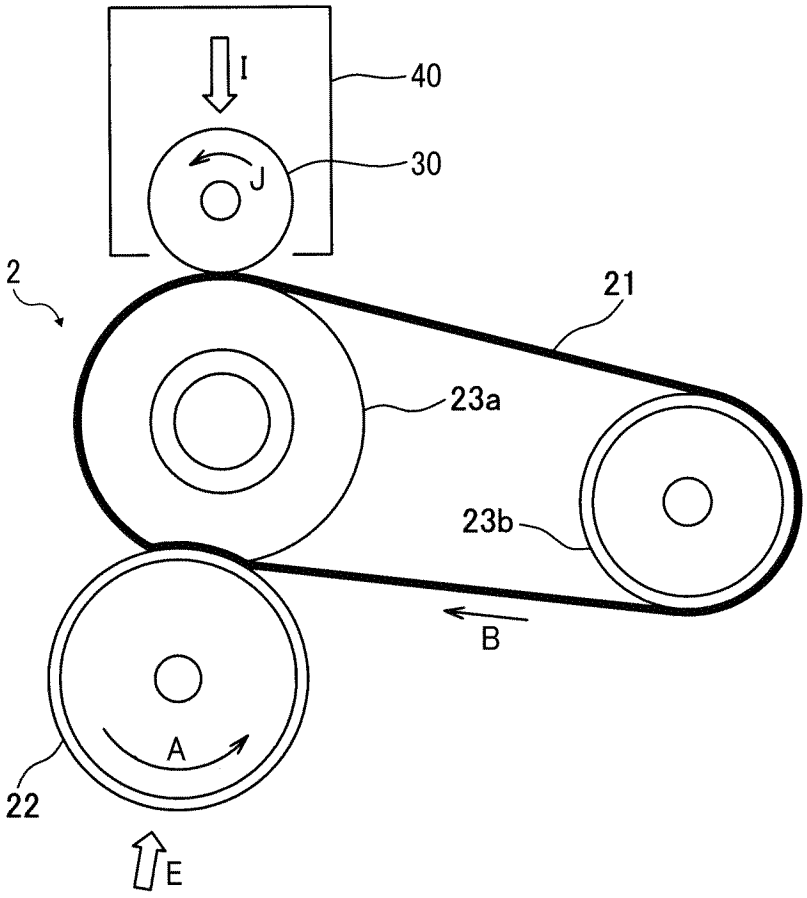
FIGS. 2A and 2B are diagrams illustrating a configuration of a fixing device included in the image forming apparatus in FIG. 1.
Figure 2A:
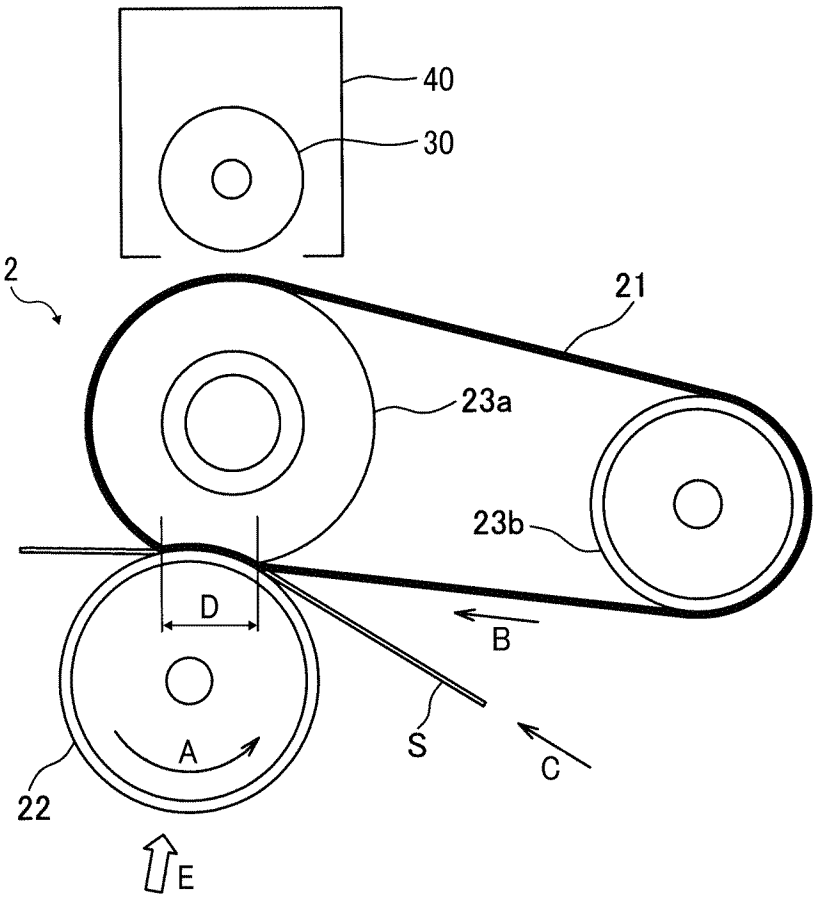

FIGS. 2A and 2B are diagrams illustrating the configuration of the fixing device 2 included in the image forming apparatus 1 in FIG. 1. FIG. 2A illustrates the fixing device 2 performing the fixing process on the recording medium S. FIG. 2B illustrates a grinding roller 30 grinding a surface of a fixing belt 21 in the fixing device 2, as described later.

The fixing device 2 in FIGS. 2A and 2B includes the endless fixing belt 21, a pressure roller 22, a plurality of tension rollers 23*a* and 23*b*, a heat source (not illustrated), and a grinding mechanism 40 including the grinding roller 30. The fixing belt 21 is wound around the tension rollers 23*a* and 23*b*. The heat source may be disposed either in at least one of the tension rollers 23*a* and 23*b* or in the pressure roller 22.

The fixing belt 21 is made of silicone rubber, and has an outer circumferential surface coated with fluororesin such as tetrafluoroethylene-perfluoroalkyl vinyl ether copolymer (PFA) to form a release layer for suppressing adhesion of the recording medium S and the pressure roller 22 to the fixing belt 21. The pressure roller 22 is configured to be pressed against the tension roller 23*a* via the fixing belt 21. Accordingly, the pressure roller 22 and the fixing belt 21 are also pressed against each other. The pressure roller 22 is driven by a drive source (not illustrated) to rotate in the direction of arrow A in FIGS. 2A and 2B. Thereby, the fixing belt 21 is driven by the rotation of the pressure roller 22 to rotate in the direction of arrow B in FIGS. 2A and 2B. In this specification, the fixing belt 21 and the pressure roller 22 are an example of a pair of rotary fixing members, and the fixing belt 21 is an example of a toner image-side rotary member that comes into contact with a toner image on a recording medium.

After the toner image is transferred to the recording medium S in the image forming unit 13 illustrated in FIG. 1, the recording medium S is fed to the fixing device 2 in the direction of arrow C in FIG. 2A from the right side of the drawing. In accordance with the rotation of the fixing belt 21, the recording medium S is moved and fed through an area of contact D in which the fixing belt 21 and the pressure roller 22 are pressed against each other.

Figure 3:
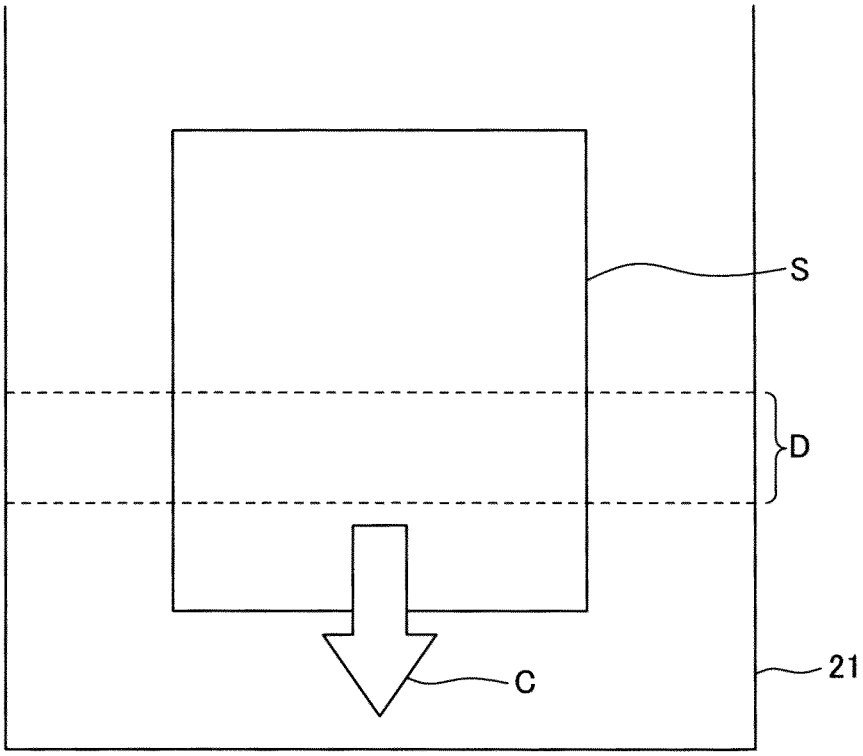
FIG. 3 is a diagram illustrating a recording medium being fed through an area of contact of a fixing belt and a pressure roller of the fixing device in FIGS. 2A and 2B viewed in the direction of arrow E in FIGS. 2A and 2B, in which the pressure roller is omitted.

FIG. 3 is a diagram illustrating the recording medium S being fed through the area of contact D of the fixing belt 21 and the pressure roller 22 viewed in the direction of arrow E in FIGS. 2A and 2B. For ease of illustration, the pressure roller 22 is omitted in FIG. 3.

In FIG. 3, the area of contact D of the fixing belt 21 and the pressure roller 22 is indicated by broken lines. The recording medium S carrying the unfixed toner image is fed through the area of contact D in the direction of arrow C in FIG. 2A and FIG. 3. In the area of contact D, the unfixed toner image is fixed on the recording medium S with heat and pressure supplied by the fixing belt 21 and the pressure roller 22.

The edges of the recording medium S may have so-called burrs from a cutting process in the manufacture of the recording medium S. If the recording medium S of a given size with the burred edges is fed through the area of contact D, the burred edges of the recording medium S may scratch portions of the fixing belt 21 and the pressure roller 22 in contact with the burred edges of the recording medium S. Particularly, the scratches formed on the surface of the fixing belt 21 that comes into contact with the unfixed toner image may affect the image quality of the fixed toner image.

Description will now be given of scratches formed on a fixing belt and the influence of the scratches on the image quality.

Figure 4:
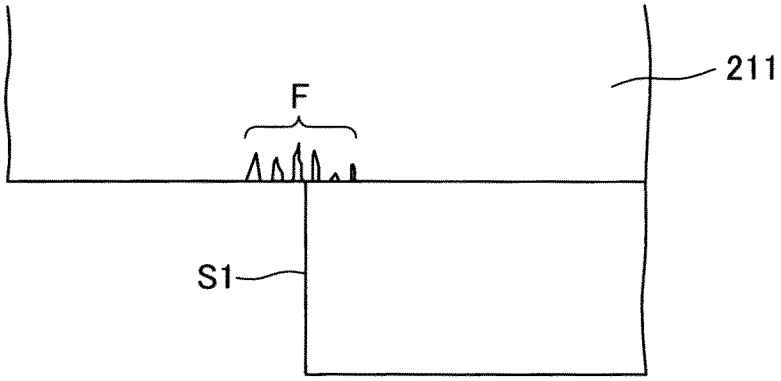
FIG. 4 is a schematic diagram illustrating a fixing belt with scratches.
Figure 5A:
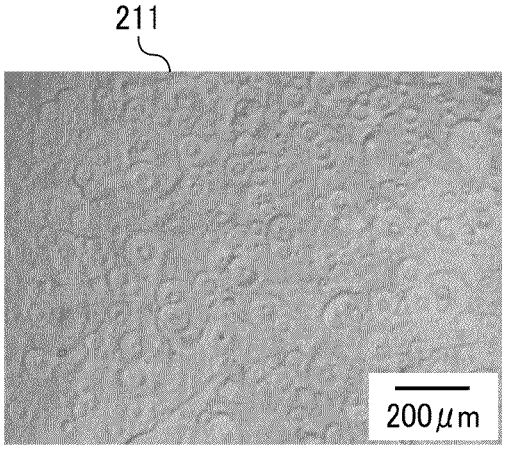
FIG. 5A is an enlarged photograph of a region of the fixing belt in FIG. 4 without the scratches.
Figure 5B:
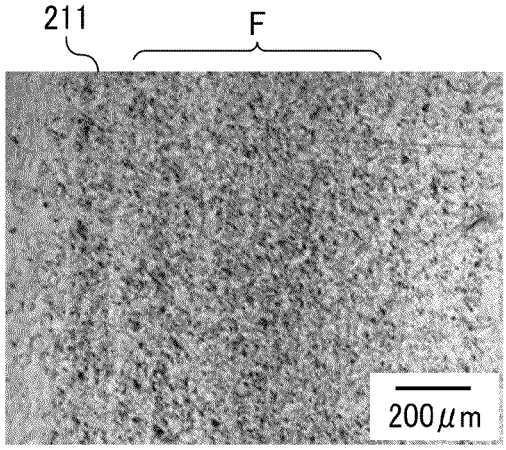
FIG. 5B is an enlarged photograph of a region of the fixing belt in FIG. 4 with the scratches.

FIG. 4 is a schematic diagram illustrating a fixing belt 211 with scratches forming one streak F and a recording medium S1. The fixing belt 211 is similar in configuration to the fixing belt 21 illustrated in FIGS. 2A and 2B. FIG. 5A is an enlarged photograph of a region of the fixing belt 211 without the scratches, and FIG. 5B is an enlarged photograph of a region of the fixing belt 211 with the scratches (i.e., streak F). The enlarged photographs were both taken with a laser microscope manufactured by Keyence Corporation.

As described above, the burred edges of the recording medium S1 may form fine scratches on the surface of the fixing belt 211. If recording media S1 of a given size are continuously fed through the fixing belt 211, the scratches formed by the burred edges of the recording media S1 may form one continuous streak F, as illustrated in FIG. 4 and the enlarged photograph of FIG. 5B.

Figure 6:
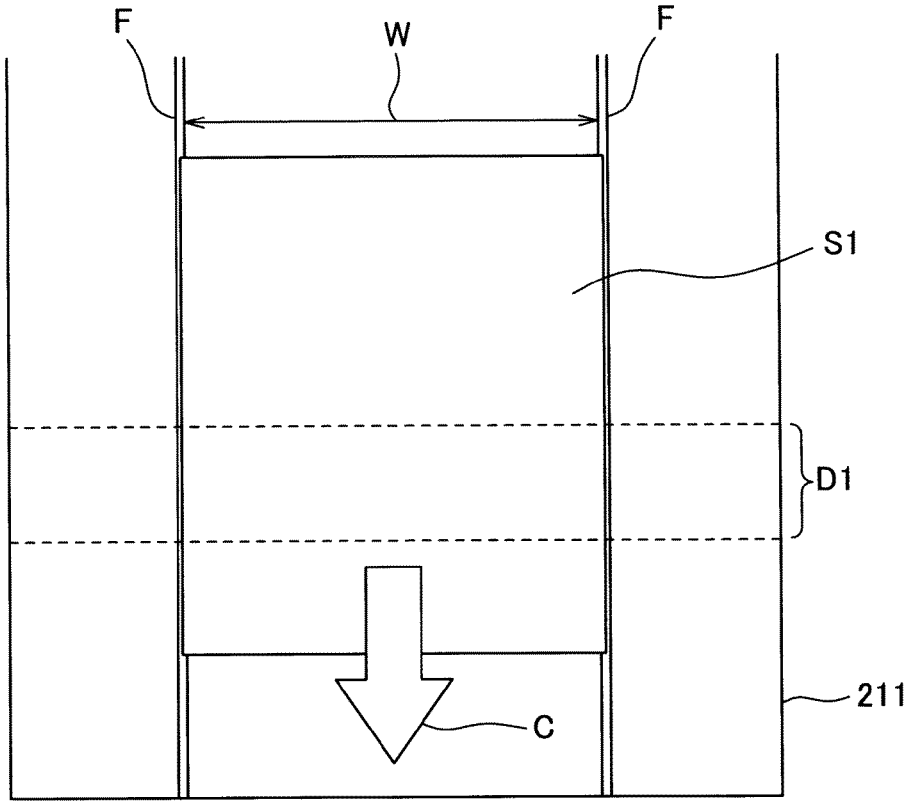
FIG. 6 is a schematic diagram illustrating streaks formed on the fixing belt in FIG. 4.

FIG. 6 is a schematic diagram illustrating the streaks F formed on the fixing belt 211. FIG. 6 also illustrates an area of contact D1 similar to the area of contact D illustrated in FIG. 2A and FIG. 3. The streaks F are formed along two edges of the recording medium S1 fed through the area of contact D1 in the direction of arrow C, i.e., along the two edges extending parallel to the medium feeding direction. As illustrated in FIG. 6, therefore, the two streaks F are separated from each other by a gap having a width W substantially equal to the width of the recording medium S1 extending in a direction perpendicular to the medium feeding direction.

If a recording medium wider than the recording medium S1 having caused the streaks F is subjected to the fixing process by the fixing belt 211 having the surface formed with the streaks F, the streaks F may be transferred to a toner image on the wide recording medium, degrading the image quality.

Figure 7:
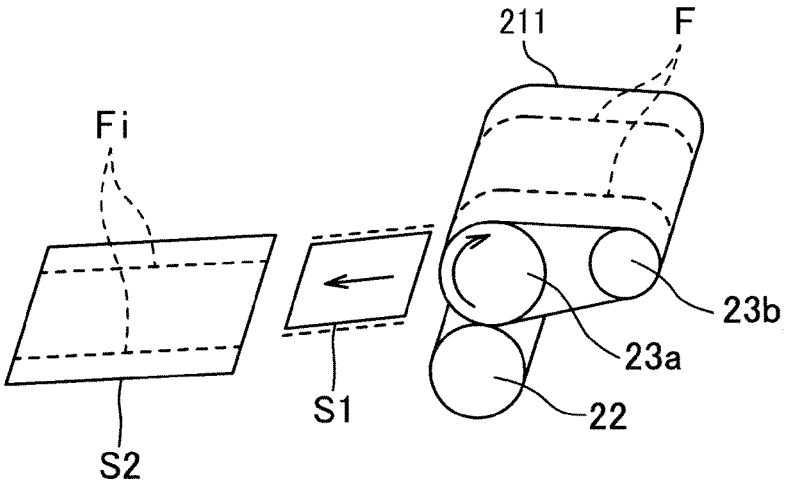
FIG. 7 is a schematic diagram illustrating a process in which the streaks formed on a surface of the fixing belt in FIG. 4 by a narrow recording medium are transferred to a toner image on a wide recording medium.
Figure 8:
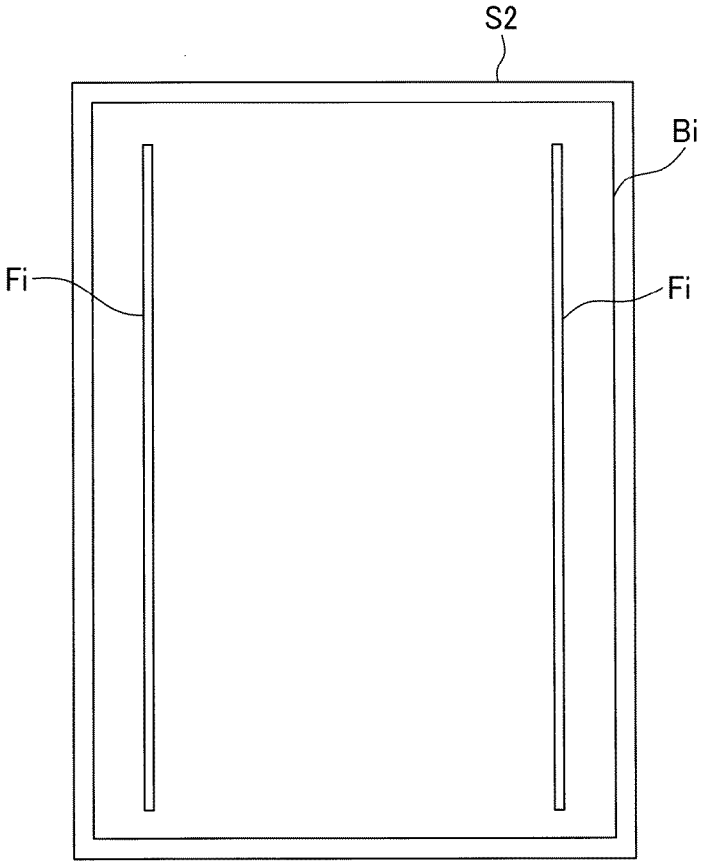
FIG. 8 is a schematic diagram of the streaks transferred to the toner image on the wide recording medium in FIG. 7 from the surface of the fixing belt in FIG. 4.
Figure 9:
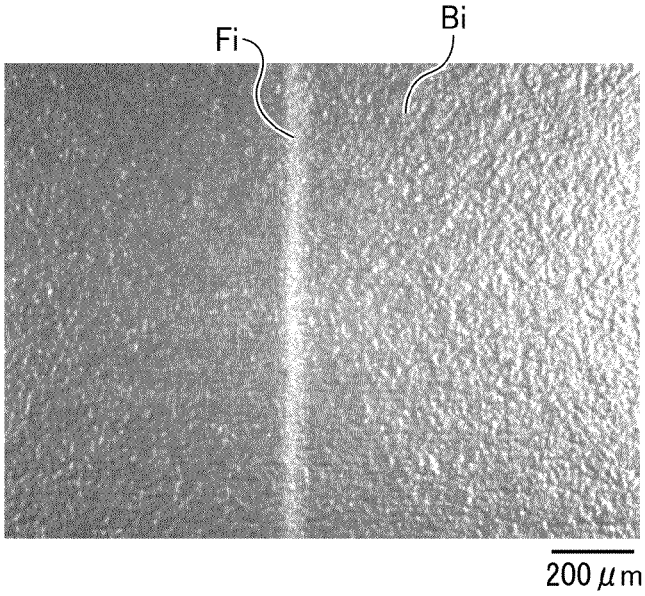
FIG. 9 is an enlarged photograph of one of the streaks transferred to the toner image on the wide recording medium in FIG. 8.

FIG. 7 is a schematic diagram illustrating a process in which the streaks F formed on the surface of the fixing belt 211 by the narrow recording medium S1 are transferred to the toner image on a wide recording medium S2 as streak Fi. FIG. 8 is a schematic diagram illustrating the streak Fi transferred from the surface of the fixing belt 211 to a solid image Bi (i.e., an example of the toner image) on the wide recording medium S2. FIG. 9 is an enlarged photograph of one of the streak Fi on the solid image Bi.

Portions of the surface of the fixing belt 211 formed with the streaks F are less glossy than the other portions of the surface of the fixing belt 211. In the solid image Bi (i.e., toner image) in contact with and fixed by the fixing belt 211, therefore, the glossiness is lower in portions in contact with the streaks F than in the other portions. As a result, the portions having the low glossiness appear as the streak Fi illustrated in FIGS. 7 to 9. That is, the streaks F formed on the surface of the fixing belt 211 degrade the image quality of the fixed toner image.

Specifically, for example, when A4-size recording media are continuously fed through the area of contact D1 with the longitudinal direction of the recording media set parallel to the medium feeding direction, the fixing belt 211 may get the two streaks F separated from each other by a distance corresponding to the width in the lateral direction of the recording media and extending parallel to the medium feeding direction. Then, if an A3-size recording medium is subjected to the fixing process, or if an A4-size recording medium is subjected to the fixing process with the lateral direction of the recording medium set parallel to the medium feeding direction, for example, the two streaks F may be transferred to the toner image on the recording medium.

Following the above description of the scratches formed on a fixing belt and the effect of the scratches on the image quality, the description will return to the fixing device 2 in FIGS. 2A and 2B.

In the fixing device 2 in FIGS. 2A and 2B, the grinding mechanism 40 grinds the surface of the fixing belt 21 with the grinding roller 30 having a width substantially equal to the width of the fixing belt 21. As illustrated in FIG. 2A, the grinding roller 30 is normally separated from the surface of the fixing belt 21. The operation of the grinding mechanism 40 is controlled by the controller 1*a* in FIG. 1.

In the image forming apparatus 1 in FIG. 1, the controller 1*a* records the type (i.e., a combination of the size and the orientation) of each of recording media S used in image formation and the number of each different type of recording media S. Further, the controller 1*a* determines whether or not the number of recording media S of A4 size, for example, fed with the longitudinal direction thereof set parallel to the medium feeding direction has reached 10,000.

If the controller 1*a* determines that the number of recording media S has reached 10,000, the controller 1*a* instructs the grinding mechanism 40 to press the grinding roller 30 against the surface of the fixing belt 21 in the direction of arrow I, as illustrated in FIG. 2B. At the same time, the grinding mechanism 40 rotates the grinding roller 30 in a direction trailing the rotation direction of the fixing belt 21, as indicated by arrow J in FIG. 2B. The circumferential speed of the grinding roller 30 is set to be faster than the circumferential speed of the fixing belt 21, as described in detail later. With this configuration, the surface of the fixing belt 21 is ground by the grinding roller 30.

In the present embodiment, the grinding roller 30 grinds the surface of the fixing belt 21 when the number of A4-size recording media S fed with the longitudinal direction thereof set parallel to the medium feeding direction reaches 10,000, for example. However, the timing of the grinding is not limited thereto. For example, the grinding may be performed when the number of A4-size recording media S reaches a predetermined number larger or smaller than 10,000. Further, the grinding may be performed when the sum of A4-size recording media S and A3-size recording media S reaches a predetermined number, or when the number of recording media S of another size, such as B5 size, reaches a predetermined number. Further, the grinding may be performed when the number of recording media S of a predetermined size and a predetermined type (e.g., thick paper) reaches a predetermined number. Further, the recording media S may be categorized in accordance with a plurality of features of the recording media S, such as size and type (e.g., thick paper), and the respective features may be weighted such that the grinding is performed when the count based on the weighting reaches a predetermined value. Alternatively, the grinding may be performed when the number of recording media S reaches a predetermined number, irrespective of the size and type of the recording media S. Further, a sensor may be provided to detect an unacceptable level of streak on the surface of the fixing belt 21, and the grinding may be performed upon detection of the streak by the sensor. The timing of the grinding may thus be set as desired at the design stage.

In addition, the grinding roller 30 is disposed above the fixing belt 21 in FIGS. 2A and 2B. However, the position of the grinding roller 30 illustrated in FIGS. 2A and 2B is illustrative and not limited thereto. The grinding roller 30 may be disposed at any position allowing the grinding roller 30 to grind the surface of the fixing belt 21. For example, the position of the grinding roller 30 may be below the fixing belt 21 or on the right or left side of the fixing belt 21.

Further, in the present embodiment, the fixing device 2 having the fixing belt 21 and the pressure roller 22 pressed against each other is described as an example of a fixing device according to an embodiment of the present invention. However, a fixing device according to an embodiment of the present invention is not limited thereto, and may have a heating roller and a pressure roller pressed against each other.

Description will now be given of general issues to be addressed in the grinding of the surface of a fixing belt.

Figure 10A:
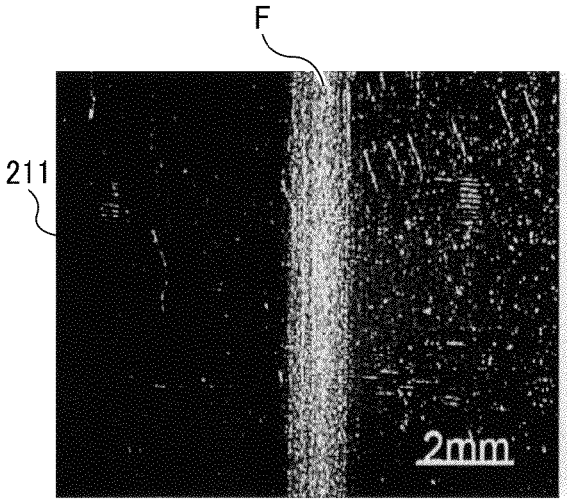
FIGS. 10A and 10B are enlarged photographs illustrating diminishment of a streak by grinding, FIG. 10A illustrating one of the streaks in FIG. 6, and FIG. 10B illustrating a diminished streak as a result of grinding the streak in FIG. 10A.
Figure 10B:
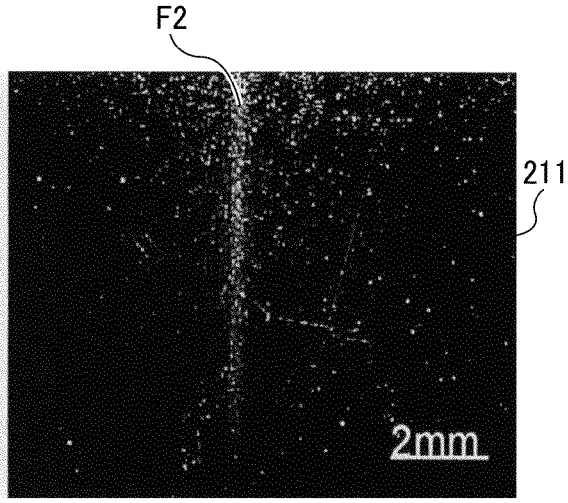

FIGS. 10A and 10B are enlarged photographs illustrating diminishment of a streak by grinding. FIG. 10A illustrates the streak F formed on the surface of the fixing belt 211. FIG. 10B illustrates a somewhat diminished streak F2 as a result of grinding the streak F.

A grinding roller for use in the grinding normally has an outer circumferential surface including abrasive grains to form a grinding surface. In the grinding, the grinding surface of the grinding roller rubs against the surface of the fixing belt 211. Thereby, the streak F is ground, and fine grinding shavings fill in the streak F. As a result, the difference between a portion of the surface of the fixing belt 211 formed with the streak F and portions of the surface of the fixing belt 211 around the streak F is reduced, diminishing the streak F, as illustrated in FIG. 10B.

From the viewpoint of productivity in image formation of the image forming apparatus, it is desirable to reduce the grinding time of the grinding roller as much as possible. As a method for reducing the grinding time, the particle size of the abrasive grains forming the grinding surface of the grinding roller may be increased as much as possible to increase the grinding amount per unit time, i.e., to improve the grinding performance per unit time of the grinding roller with such a grinding surface. The increase in particle size of the abrasive grains forming the grinding surface, however, results in a reduction in glossiness of the surface of the fixing belt 211 and thus a reduction in glossiness of the fixed toner image.

Figure 11:
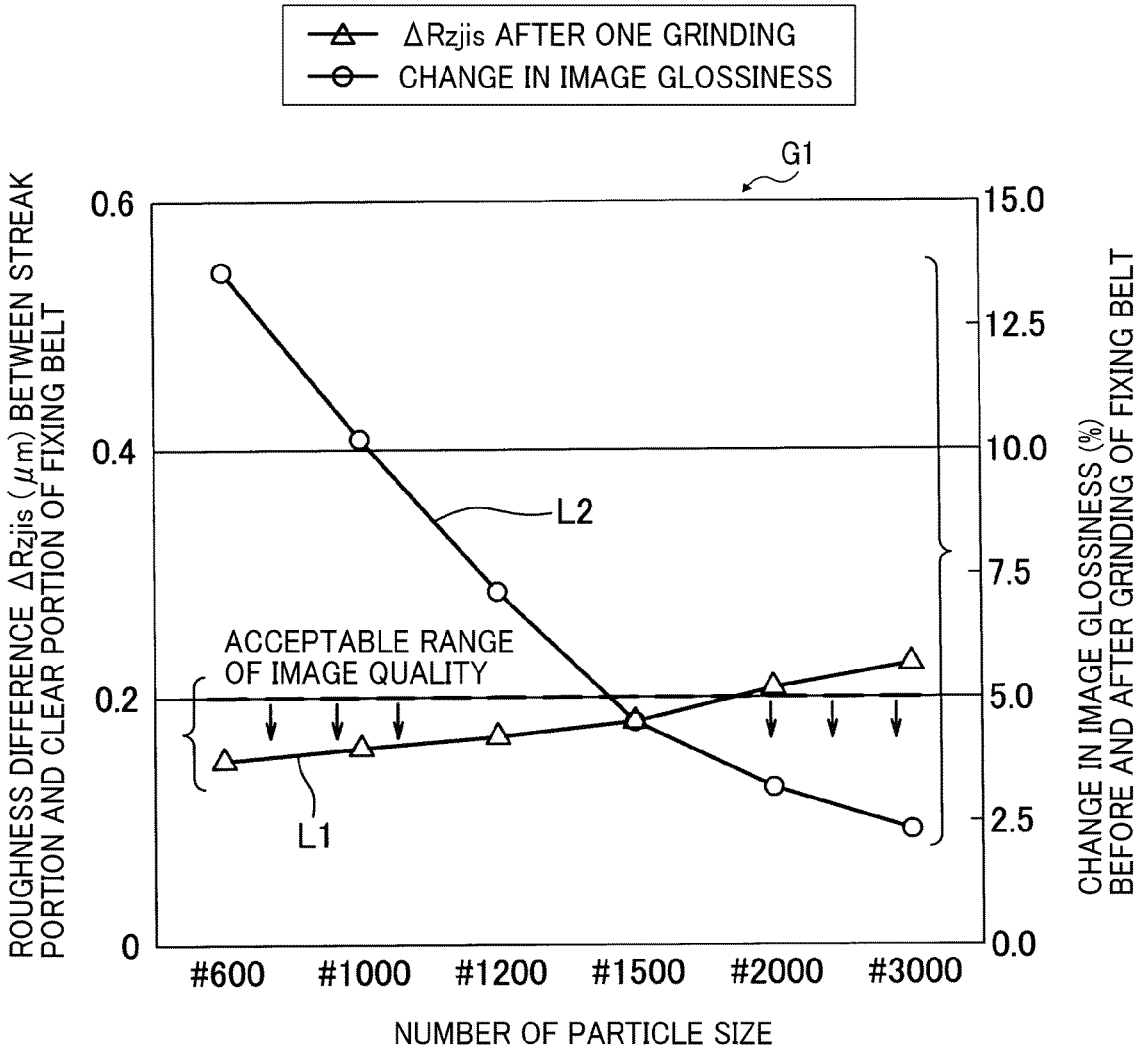
FIG. 11 is a graph illustrating the change in grinding performance and the change in reduction of image glossiness relative to the change in particle size of abrasive grains.

FIG. 11 is a graph illustrating the change in grinding performance and the change in reduction of image glossiness relative to the change in particle size of the abrasive grains. In graph G1 illustrated in FIG. 11, the horizontal axis represents the particle size of the abrasive grains. TABLE 1 given below illustrates the relationship between the number representing the particle size of the abrasive grains and the mean particle diameter 50 D at 50% point of cumulative height according to the electrical resistance test method.

TABLE 1

| number of particle size | maximum particle diameter (μm) | mean particle diameter D50 (μm) |
|---|---|---|
| #600 | ≤53.0 | 21.1 ± 1.5 |
| #1000 | ≤32.0 | 11.9 ± 1.0 |
| #1200 | ≤27.0 | 9.90 ± 0.80 |
| #1500 | ≤23.0 | 8.40 ± 0.60 |
| #2000 | ≤19.0 | 6.90 ± 0.60 |
| #3000 | ≤13.0 | 4.00 ± 0.50 |

In graph G1, the vertical axis on the left side of FIG. 11 represents the grinding performance. Herein, the grinding performance is represented by the difference between the roughness of the portion of the fixing belt 211 formed with a streak (hereinafter referred to as streak portion) and the roughness of the other portion of the fixing belt 211 (hereinafter referred to as clear portion) measured after grinding the fixing belt 211 for 3 minutes. Further, the ten-point mean roughness $Rz_{jis}$ is employed to specify a roughness curve of the surface of the fixing belt 211. In graph G1 of FIG. 11, the difference $\Delta Rz_{jis}$ in ten-point mean roughness $Rz_{jis}$ (hereinafter referred to as ten-point mean roughness difference $\Delta Rz_{jis}$) between the streak portion and the clear portion represents the grinding performance. The ten-point mean roughness difference $\Delta Rz_{jis}$ represents the degree of noticeability of the streak remaining after the grinding. That is, the smaller the ten-point mean roughness difference $\Delta Rz_{jis}$ is, the higher the grinding performance is. Conversely, the larger the ten-point mean roughness difference $\Delta Rz_{jis}$ is, the lower the grinding performance is.

The vertical axis on the right side of FIG. 11 represents the reduction in image glossiness due to the grinding. Herein, the reduction in image glossiness is represented by the ratio of the difference between the glossiness of the toner image fixed by the fixing device 2 before the grinding of the fixing belt 211 and the glossiness of the toner image fixed by the fixing device 2 after the grinding of the fixing belt 211 to the glossiness of the toner image fixed by the fixing device 2 before the grinding of the fixing belt 211.

Also herein, the grinding time is set to 3 minutes.

In graph G1, solid line L1 connecting triangles represents the change in grinding performance relative to the change in particle size of the abrasive grains, and solid line L2 connecting circles represents the change in reduction of image glossiness relative to the change in particle size of the abrasive grains.

As understood from solid line L1, the grinding performance improves with the increase in particle size of the abrasive grains. Meanwhile, the image glossiness reduces with the increase in particle size of the abrasive grains, as understood from solid line L2. The reduction in image glossiness is due to the increase in depth of grinding with the increase in particle size of the abrasive grains.

For practical use, grinding performance corresponding to a ten-point mean roughness $Rz_{jis}$ of 0.2 μm or less and a reduction in image glossiness of 5% or less is desirable. As understood from the two solid lines L1 and L2 in graph G1, the particle size satisfying the above two conditions corresponds to number #1500. If the 3-minute grinding is repeatedly executed, however, recesses of the irregularities in the grinding surface may be clogged with the grinding shavings, degrading the grinding performance. In reality, therefore, it is desirable to set the grinding time to be longer than 3 minutes in consideration of the degradation of the grinding performance due to such clogging, even with the use of the abrasive grains having a particle size corresponding to number #1500. From the viewpoint of productivity, however, it is desirable to set the grinding time within 3 minutes. Accordingly, it is desirable to provide a grinding roller capable of reducing the grinding time with improved grinding performance while suppressing the reduction in image glossiness, i.e., the reduction in glossiness of the surface of the fixing belt 211.

Following the above description of the general issues to be addressed in the grinding of the surface of a fixing belt, the grinding roller 30 and the grinding mechanism 40 will now be described.

Figure 12:
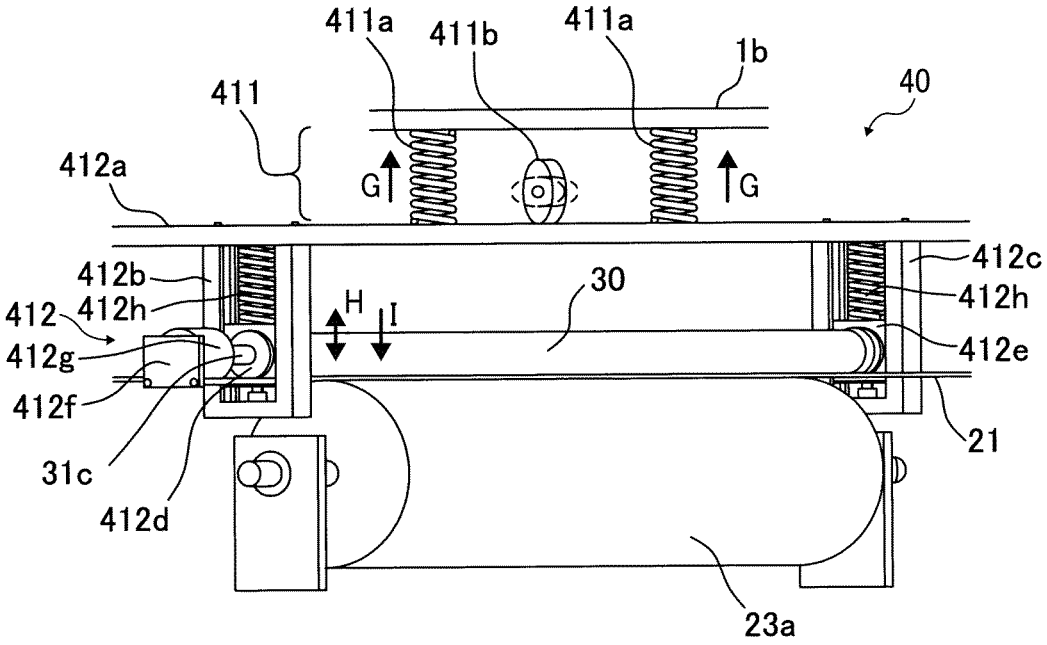
FIG. 12 is a diagram illustrating details of a grinding mechanism included in the fixing device in FIGS. 2A and 2B.

FIG. 12 is a diagram illustrating details of the grinding mechanism 40 illustrated in FIGS. 2A and 2B. The grinding mechanism 40 illustrated in FIG. 12 includes a grinding roller contacting and separating mechanism 411 and a grinding roller rotating and pressing mechanism 412. As described above, the operation of the grinding mechanism 40 is controlled by the controller 1*a* illustrated in FIG. 1.

The grinding roller contacting and separating mechanism 411 includes contacting and separating springs 411*a* and a contacting and separating cam 411*b*. The contacting and separating springs 411*a* bias the grinding roller 30, more specifically the grinding roller rotating and pressing mechanism 412 supporting the grinding roller 30, in the direction of arrows G toward a frame 1*b* of the image forming apparatus 1 illustrated in FIG. 1.

In the present embodiment, the contacting and separating cam 411*b* is in the posture indicated by a broken line in FIG. 12 until the controller 1*a* in FIG. 1 determines that the number of A4-size recording media S fed with the longitudinal direction thereof set parallel to the medium feeding direction has reached 10,000. Therefore, the contacting and separating springs 411*a* keep the grinding roller 30 separated from the surface of the fixing belt 21 until the controller 1*a* makes the above-described determination. If the controller 1*a* makes the above-described determination, the controller 1*a* instructs a not-illustrated motor to rotate the contacting and separating cam 411*b* to the posture indicated by a solid line in FIG. 12, thereby bringing the grinding roller 30 into contact with the surface of the fixing belt 21.

The grinding roller rotating and pressing mechanism 412 includes a mechanism frame 412*a*, two guide frames 412*b* and 412*c*, two bearings 412*d* and 412*e*, a motor fixing portion 412*f*, a grinding roller motor 412*g*, and two pressing springs 412*h*. The guide frames 412*b* and 412*c* are fixed to respective positions of the mechanism frame 412*a* corresponding to shafts 31*c* at opposed ends of the grinding roller 30. In the view illustrated in FIG. 12, only the left shaft 31*c* is visible. The mechanism frame 412*a* is attached to the grinding roller contacting and separating mechanism 411, which in turn is attached to the frame 1*b* of the image forming apparatus 1 as described above.

The bearings 412*d* and 412*e* for rotatably supporting the shafts 31*c* of the grinding roller 30 are fitted in the guide frames 412*b* and 412*c*, respectively, to be slidable in the direction of arrow H. In FIG. 12, the grinding roller motor 412*g* is fixed to the motor fixing portion 412*f* attached to the left bearing 412*d* fitted in the left guide frame 412*b*. The grinding roller motor 412*g* has a rotary shaft connected to the shaft 31*c* of the grinding roller 30 supported by the left bearing 412*d*.

The two pressing springs 412*h* are disposed between the mechanism frame 412*a* and the bearings 412*d* and 412*e*. The pressing springs 412*h* bias the shafts 31*c* of the grinding roller 30 in the direction of arrow I via the bearings 412*d* and 412*e*. When the contacting and separating cam 411*b* of the grinding roller contacting and separating mechanism 411 rotates to the posture indicated by the solid line in FIG. 12, the two pressing springs 412*h* press the grinding roller 30 against the surface of the fixing belt 21. In the present embodiment, the pressing springs 412*h* press the grinding roller 30 against the surface of the fixing belt 21 with a pressure of approximately 1 N/mm.

In the grinding mechanism 40, when the contacting and separating cam 411*b* of the grinding roller contacting and separating mechanism 411 rotates to the posture indicated by the solid line in FIG. 12 in accordance with the instruction from the controller la in FIG. 1, the grinding roller motor 412*g* rotates the grinding roller 30. In this case, the grinding roller 30 rotates in the direction trailing the rotation direction of the fixing belt 21, as indicated by arrow J in FIG. 2B. In the present embodiment, the circumferential speed of the fixing belt 21 is 160 mm/sec, and the circumferential speed of the grinding roller 30 is 960 mm/sec. With the difference in circumferential speed between the fixing belt 21 and the grinding roller 30, the surface of the fixing belt 21 is ground.

The rotation direction of the grinding roller 30 is not limited to the trailing direction according to the present embodiment. Further, in the present embodiment, the circumferential speed of the grinding roller 30 rotating in the trailing direction is not limited to the above-described value, and may be any value causing the difference in circumferential speed between the grinding roller 30 and the fixing belt 21.

Figure 13:
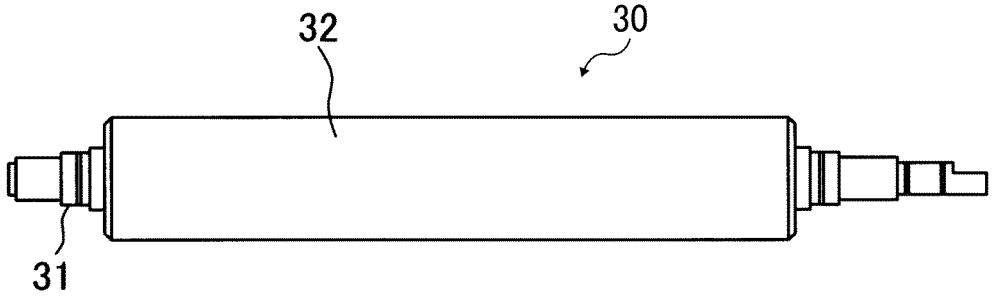
FIG. 13 is a diagram illustrating the exterior of a grinding roller included in the grinding mechanism in FIG. 12.

FIG. 13 is a diagram illustrating the exterior of the grinding roller 30. The grinding roller 30 includes a core rod 31 and an abrasive grain layer 32. In the fixing device 2, the grinding roller 30 is subjected to a temperature history from normal temperature to high temperature close to 150° C. It is therefore desirable that the core rod 31 is rust-resistant. Although a stainless steel-based metal is preferable as the material of the core rod 31, free-cutting steel may be used to form the core rod 31. If free-cutting steel is used to form the core rod 31, the surface of the free-cutting steel formed into the shape of the core rod 31 is coated with Ni plating of approximately 3 μm in thickness. The core rod 31 made of free-cutting steel is easier to process and thus is more advantageous in manufacturing cost than the core rod 31 made of a stainless steel-based metal.

The abrasive grain layer 32 is formed by a mixture of silicone rubber and abrasive grains formed around the outer circumferential surface of the core rod 31, and has a thickness of approximately 100 μm. The present embodiment employs alumina-based abrasive grains having a particle size corresponding to number #1500. As well as the alumina-based abrasive grains, silicon carbide-based abrasive grains, zirconia-based abrasive grains, or boron nitride-based abrasive grains may be employed. Further, the present embodiment employs fillerless silicone rubber to enhance the binding force of the alumina-based abrasive grains with a small amount of silicone rubber. Further, the silicone rubber is of a 2-liquid mixture, curing-type having a JIS (Japanese Industrial Standard)-A hardness of 65 after secondary vulcanization. That is, the present embodiment employs a hard silicone rubber, which also contributes to the enhancement of the binding force of the alumina-based abrasive grains.

Figure 14:
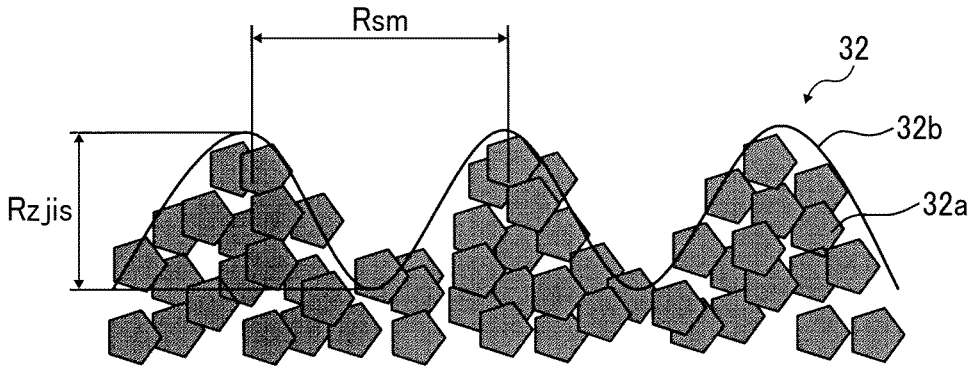
FIG. 14 is a schematic diagram illustrating irregularities in a surface of an abrasive grain layer of the grinding roller in FIG. 13.

The abrasive grain layer 32 has an outer circumferential surface with irregularities illustrated in FIG. 14. FIG. 14 is a schematic diagram illustrating the irregularities in the surface of the abrasive grain layer 32. As illustrated in FIG. 14, each of the irregularities in the surface of the abrasive grain layer 32 is greater than an abrasive grain 32*a* in both ten-point mean roughness $Rz_{jis}$ and mean length Rsm for specifying a roughness curve of a surface, which are defined in JIS-B-0601. Further, the irregularities include projections 32*b* each formed by an aggregate of a plurality of abrasive grains 32*a*. The abrasive grain layer 32 is an example of an abrasive grain layer according to an embodiment of the present invention, and the projections 32*b* are an example of projections according to an embodiment of the present invention.

In the present embodiment, the irregularities each greater than the abrasive grain 32*a* in both ten-point mean roughness $Rz_{jis}$ and mean length Rsm for specifying a roughness curve are described as an example of irregularities according to an embodiment of the present invention. However, irregularities according to an embodiment of the present invention are not limited thereto. For example, the irregularities may each be greater than the abrasive grain 32*a* in one of ten-point mean roughness $Rz_{jis}$ and mean length Rsm.

Figure 15:
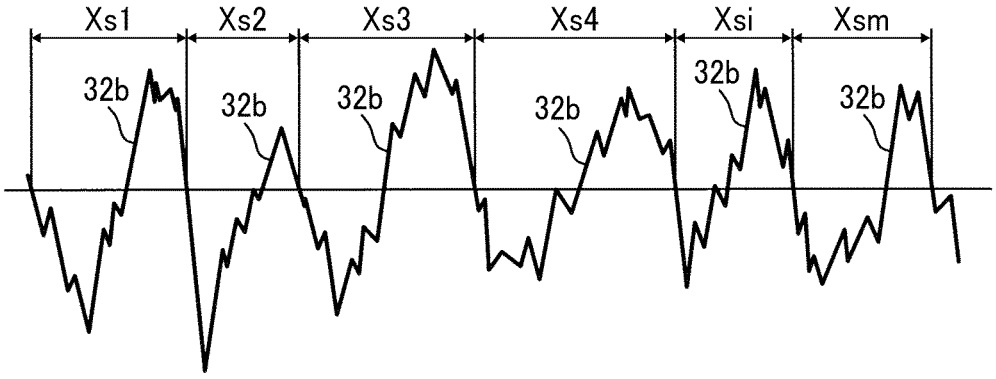
FIG. 15 is a schematic diagram illustrating a roughness curve of the surface of the abrasive grain layer in FIG. 14.

FIG. 15 is a schematic diagram illustrating the roughness curve of the surface of the abrasive grain layer 32. As illustrated in FIG. 15, the mean length Rsm is the mean value of the distances between descending slopes of two adjacent projections 32*b*, which is defined by the following expression.

$$Rsm = \frac{1}{m}\sum_{i=1}^{m} Xsi \tag{1}$$

The projections 32*b* of the irregularities in the surface of the abrasive grain layer 32 behave like abrasive grains having a large particle diameter. In graph G1 of FIG. 11, therefore, higher grinding performance than the grinding performance corresponding to the particle size of the abrasive grains 32*a* actually forming the abrasive grain layer 32 is obtained. As well as the ten-point mean roughness difference $\Delta Rz_{jis}$ between the streak portion and the clear portion illustrated in graph G1, the simple grinding amount per unit time (hereinafter referred to as grinding efficiency (μm/hour)) may be used as the indicator of the grinding performance. In the abrasive grain layer 32 having the surface with the above-described irregularities, the grinding efficiency (μm/hour) increases with the increase in mean length Rsm of the irregularities.

Figure 16:
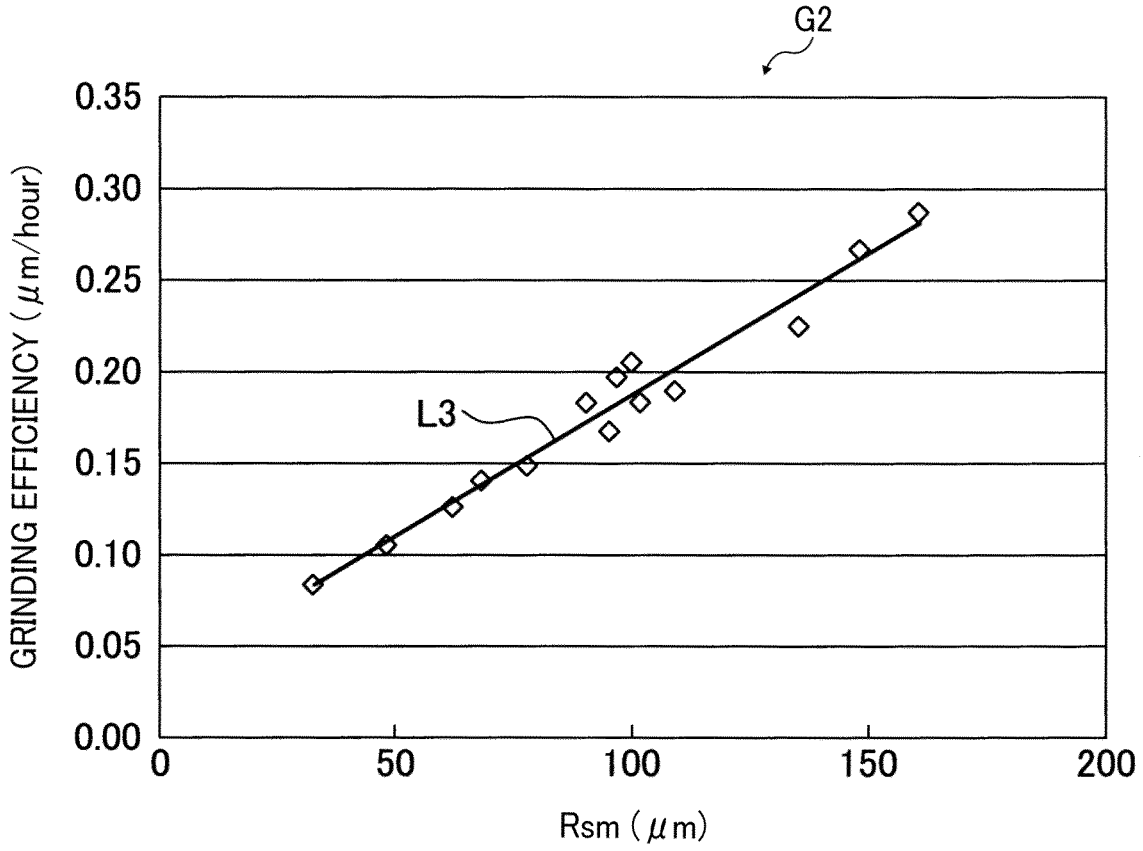
FIG. 16 is a graph illustrating grinding efficiency (μm/hour) relative to various values of mean length Rsm.

FIG. 16 is a graph illustrating the grinding efficiency (μm/hour) relative to various values of the mean length Rsm. In graph G2 illustrated in FIG. 16, the horizontal axis represents the mean length Rsm of the irregularities in the surface of the abrasive grain layer 32, and the vertical axis represents the grinding efficiency (μm/hour). The values of the grinding efficiency (μm/hour) corresponding to the respective values of the mean length Rsm are plotted with rhombuses. As indicated by upward sloping solid line L3 corresponding to the arrangement of the rhombuses, it is understood that the grinding efficiency (μm/hour) increases with the increase in mean length Rsm.

Grinding dust produced by the grinding with the abrasive grain layer 32 having the surface with the above-described irregularities moves not to narrow spaces between the abrasive grains 32*a* but to wide recesses between the projections 32*b* of the irregularities. Consequently, the above-described clogging is suppressed over repeated grindings, thereby maintaining high grinding performance.

Figure 17:
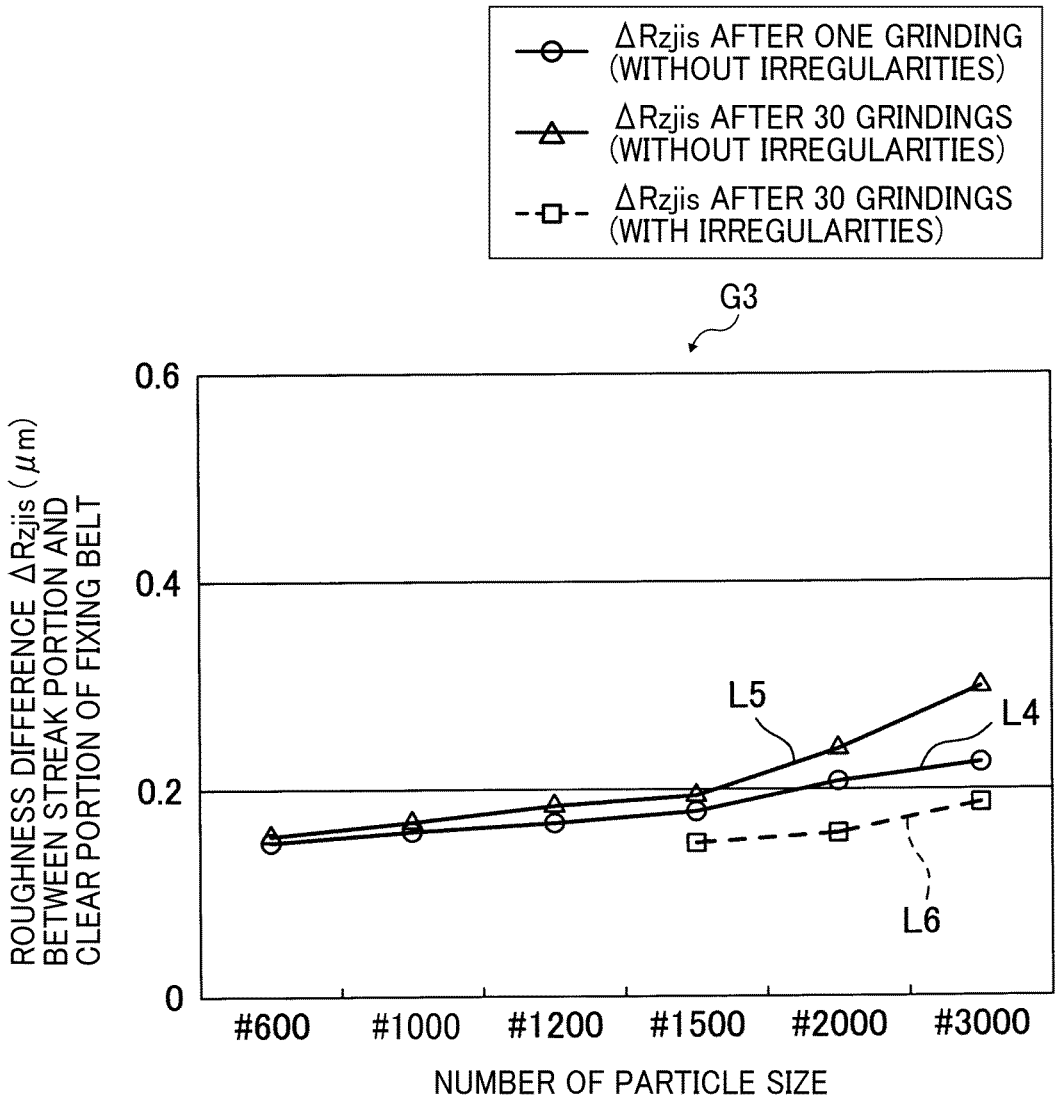
FIG. 17 is a graph illustrating high grinding performance maintained over repeated grindings.

FIG. 17 is a graph illustrating high grinding performance maintained over repeated grindings. In graph G3 of FIG. 17, the horizontal axis represents the number of the particle size of the abrasive grains, and the vertical axis represents the ten-point mean roughness difference $\Delta Rz_{jis}$ between the portion of the fixing belt 21 formed with the streak (i.e., streak portion) and the other portion of the fixing belt 21 (i.e., clear portion) measured after grinding. In graph G3, the ten-point mean roughness difference $\Delta Rz_{jis}$ after one 3-minute grinding is plotted with a circle for each of grinding rollers of different particle size numbers having a surface without irregularities. Further, the ten-point mean roughness difference $\Delta Rz_{jis}$ after fixing processes on 300,000 recording media, i.e., after 30 3-minute grindings each performed every 10,000 recording media, is plotted with a triangle for each of the grinding rollers of different particle size numbers having a surface without irregularities. Further, the ten-point mean roughness difference $\Delta Rz_{jis}$ after the 30 3-minute grindings is plotted with a square for each of grinding rollers of different particle size numbers having a surface with the above-described irregularities. Herein, a desirable duration number, i.e., a desirable number of grindings for maintaining a certain level of grinding performance in practical use of the grinding roller, is 30.

From the comparison between solid line L4 connecting the circles and solid line L5 connecting the triangles, it is understood that the ten-point mean roughness difference $\Delta Rz_{jis}$ is increased after 30 grindings in all of the grinding rollers of different particle size numbers having a surface without irregularities. As described above, the ten-point mean roughness difference $\Delta Rz_{jis}$ represents the degree of noticeability of the streak remaining on the surface of the ground fixing belt 21. It is therefore understood from the comparison between two solid lines L4 and L5 that the grinding performance of the grinding rollers is degraded after 30 grindings. Meanwhile, it is understood from solid line L6 connecting the squares that the grinding roller of a particle size corresponding to number #1500 or any larger number having a surface with the irregularities, which is to be used as the grinding roller 30 of the fixing device 2, maintains high grinding performance even after 30 grindings.

The grinding roller 30 according to the present embodiment having a surface with the irregularities maintains the above-described high grinding performance since the clogging due to grinding dust is suppressed as described above.

Figure 18:
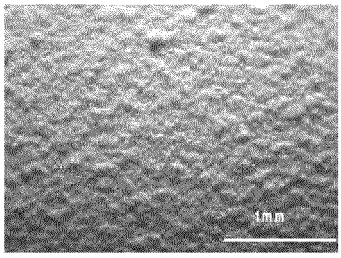
FIG. 18 illustrates enlarged photographs of a surface with irregularities in the grinding roller according to the present embodiment and a surface without irregularities in a grinding roller according to a comparative example before and after 30 grindings each performed every 10,000 sheets.
Figure 18:
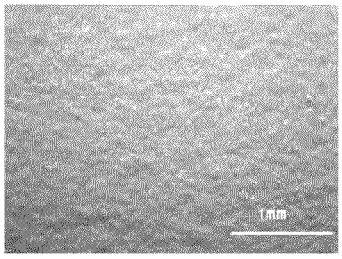
Figure 18:
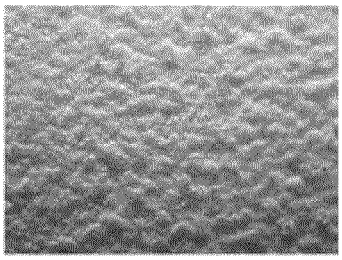
Figure 18:
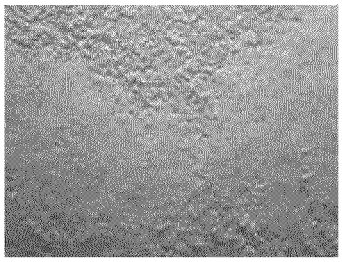

FIG. 18 illustrates enlarged photographs of a surface with irregularities in the grinding roller 30 according to the present embodiment and a surface without irregularities in a grinding roller according to a comparative example before and after 30 grindings (each performed every 10,000 recording media) magnified 15×. Herein, the grinding time is 3 minutes.

It is observed from the enlarged photographs of FIG. 18 that there is little change in the surface of the grinding roller 30 according to the present embodiment before and after 30 grindings, while the clogging due to grinding dust appears on the surface of the grinding roller according to the comparative example after 30 grindings. The irregularities in the surface of the grinding roller 30 in the enlarged photographs of FIG. 18 have a mean length Rsm of 78 μm.

Since the grinding roller 30 according to the present embodiment thus maintains high grinding performance over repeated grindings, for example, it is possible to set the grinding time of each of the grindings to a short time of 3 minutes, for example. Further, in the grinding roller 30 according to the present embodiment, if the projections 32*b* of the irregularities illustrated in FIG. 14 are increased in size, the grinding performance is improved, as described above. Meanwhile, if the number of the particle size of the abrasive grains 32*a* forming the abrasive grain layer 32 becomes larger, the reduction in glossiness of the surface of the fixing belt 21 due to grinding is more suppressed. With the fine abrasive grains 32*a* having a particle size corresponding to number #1500 or any larger number, therefore, the abrasive grain layer 32 having the above-described irregularities obtains high grinding performance due to the projections 32*b* of the irregularities while suppressing the reduction in glossiness due to the grinding.

From the viewpoint of suppression of the above-described clogging, it is preferable that the mean length Rsm of the irregularities is 60 μm or greater. With the mean length Rsm of 60 μm or greater, the clogging is suppressed in the grinding roller 30 even after the desirable duration number of grindings (e.g., 30 grindings), which depends on the model of the image forming apparatus 1. Further, from the viewpoint of limitation of formation of the irregularities according to a later-described method, it is desirable that the mean length Rsm is 160 μm or less.

In the present embodiment, the abrasive grain layer 32 illustrated in FIG. 13 is formed by a mixture of silicone rubber and the abrasive grains 32*a*. It is desirable that the weight ratio of the abrasive grains 32*a* to the mixture is 65% or higher for the following reason.

Figure 19:
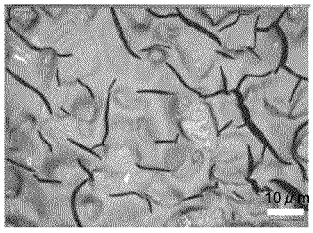
FIG. 19 illustrates enlarged photographs of respective surfaces of three types of grinding rollers having different abrasive grain ratios, i.e., different weight ratios of abrasive grains to a mixture of abrasive grains and silicone rubber.
Figure 19:
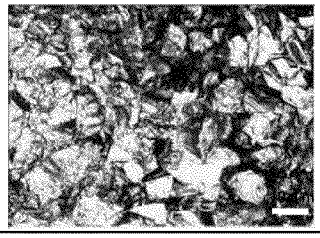
Figure 19:
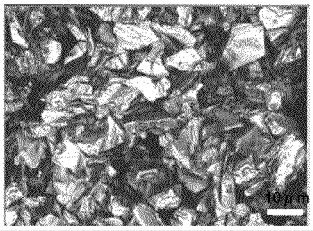
Figure 19:
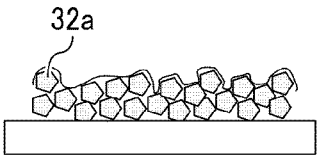
Figure 19:
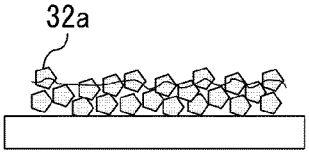
Figure 19:
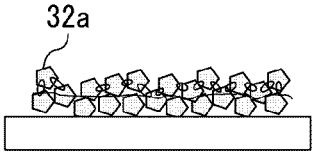

FIG. 19 illustrates enlarged photographs of respective surfaces of three types of grinding rollers different in abrasive grain ratio, i.e., weight ratio of the abrasive grains 32*a* to the mixture. Specifically, FIG. 19 illustrates enlarged photographs of respective surfaces of a grinding roller having an abrasive grain ratio of 60%, a grinding roller having an abrasive grain ratio of 68%, and a grinding roller having an abrasive grain ratio of 80%. FIG. 19 further illustrates, below the enlarged photographs, schematic diagrams of abrasive grain layers 32-1, 32-2, and 32-3 of the three types of grinding rollers. Herein, each of the grinding rollers is configured to have a surface without irregularities for visibility of changes in surface state of the grinding roller according to the weight ratio of the abrasive grains 32*a*.

In the enlarged photograph of the surface of the abrasive grain layer 32-1 having an abrasive grain ratio of 60%, the abrasive grains 32*a* are buried in the silicone rubber. The grinding roller having such a surface usually fails to obtain sufficient grinding performance due to slippage of the surface of the abrasive grain layer 32-1 on the fixing belt 21. Meanwhile, in each of the enlarged photographs of the surface of the abrasive grain layer 32-2 having an abrasive grain ratio of 68% and the surface of the abrasive grain layer 32-3 having an abrasive grain ratio of 80%, the abrasive grains 32*a* are exposed from the silicone rubber. The grinding rollers with the thus-exposed abrasive grains 32*a* obtain desired grinding performance.

If the abrasive grain ratio is lower than 65%, the abrasive grains 32*a* may be buried in the silicone rubber, as illustrated in the enlarged photograph of the surface of the grinding roller having an abrasive grain ratio of 60% in FIG. 19. Meanwhile, if the abrasive grain ratio is 65% or higher, the abrasive grains 32*a* are highly possibly exposed from the silicone rubber, as illustrated in the enlarged photographs of the surface of the grinding roller having an abrasive grain ratio of 68% and the surface of the grinding roller having an abrasive grain ratio of 80% in FIG. 19. Such a relationship between the abrasive grain ratio and the surface state of the grinding roller is also applicable to a grinding roller having a surface with irregularities, such as the grinding roller 30 according to the present embodiment. From the viewpoint of exposure of the abrasive grains 32*a*, therefore, it is desirable that the weight ratio of the abrasive grains 32*a* to the mixture of the silicone rubber and the abrasive grains 32*a* is 65% or higher.

In the present embodiment, the surface of the core rod 31 is spray-coated with the mixture of the silicone rubber and the abrasive grains 32*a* to form the abrasive grain layer 32 having a surface with the above-described irregularities. If the weight ratio of the abrasive grains 32*a* to the mixture is set to 65% or higher, as described above, the mixture is semisolid and has low fluidity even before cross-linking. The mixture in this state is unsuitable for spray coating. Therefore, the mixture is diluted with a hydrocarbon-based solvent to give it a low viscosity. In the present embodiment, toluene is employed to dilute the mixture to approximately 50% to adjust the viscosity of the mixture to 100 mPa·s (milli Pascal per second) or less.

The dryness of particles of the mixture sprayed onto the surface of the core rod 31 and the diameter of the sprayed particles are adjustable by adjustment of the above-described viscosity, the distance between a spray gun used for spray coating and the surface of the core rod 31, and the diameter of a nozzle of the spray gun. In the present embodiment, with the adjustment of these parameters, the sprayed particles of the mixture having a size of tens to hundreds of micrometers are deposited on the surface of the core rod 31 with the outer diameter of the core rod 31 partially maintained. Thereby, the abrasive grain layer 32 having a surface with the above-described irregularities is formed.

If the ten-point mean roughness $Rz_{jis}$ and the mean length Rsm of the irregularities are simply increased by the adjustment of the above-described conditions, air gaps in the abrasive grain layer 32 may be increased. For example, in the abrasive grain layer 32-3 having an abrasive grain ratio of 80% in FIG. 19, some of the abrasive grains 32*a* located near the surface of the abrasive grain layer 32-3 are not immersed in the silicone rubber, but are bonded together by some of the silicone rubber present therebetween. Therefore, air gaps are present in the abrasive grain layer 32-3. If the irregularities in the abrasive grain layer 32 are formed with such a high abrasive grain ratio, air gaps are also present in the abrasive grain layer 32. If the air gaps are increased, the binding force of the abrasive grains 32*a* is reduced, increasing the possibility that the projections 32*b* of the irregularities on the surface of the abrasive grain layer 32 crumble during the grinding. To avoid such crumbling, it is desirable that the abrasive grain layer 32 has a density of $1.15\times10^{-3}$ g/mm$^3$ or higher.

Further, it is preferable that the abrasive grains 32*a* have a particle size corresponding to number #1500 or a larger number. The particle size corresponding to number #1500 or a larger number corresponds to 9 μm or less in mean particle diameter at 50% point of cumulative height according to the electrical resistance test method. With the use of such abrasive grains having a certain level of fineness, the effect of suppressing the reduction in glossiness of the ground fixing belt 21 is enhanced.

The above-described embodiments and effects thereof are merely illustrative of representative embodiments of the present invention, and do not limit the present invention. That is, a person skilled in the art could modify the embodiments in various ways within the gist of the present invention in light of the disclosed teachings. Any modification including the configuration of a grinding roller according to an embodiment of the present invention is included in the scope of the present invention.

Description will now be given of embodiment examples in which actual image formation was performed with the image forming apparatus 1 according to the above-described embodiment. In the following embodiment examples, description will be given of specific sizes and materials of the grinding roller 30. However, such sizes and materials are illustrative only, and the present invention is not limited thereto.

In a first embodiment example, the image forming apparatus 1 illustrated in FIG. 1 includes the fixing device 2 having the grinding roller 30 illustrated in FIG. 13. The grinding roller 30 has a length of 338 mm excluding the length of the shafts on the opposed ends thereof and a diameter of 14 mm. The core rod 31 is made of stainless steel JIS SUS303, which is free-cutting steel, and has an outer circumferential surface coated with Ni plating of approximately 3 μm in thickness. Further, the core rod 31 has a length of 338 mm excluding the length of the shafts on the opposed ends thereof and a diameter of 13.8 mm.

The abrasive grain layer 32 includes, as the abrasive grains 32*a*, white alumina abrasive grains manufactured by Fujimi Incorporated and having a particle size corresponding to number #1500 according to the electrical resistance test method. The abrasive grain layer 32 also includes, as a binder, silicone rubber manufactured by Dow Corning Toray Co., Ltd. The silicone rubber is of a 2-liquid mixture, curing, fillerless type having a JIS-A hardness of 65 after secondary vulcanization. The abrasive grain layer 32 has a thickness of 0.1 mm.

The abrasive grain layer 32 is formed by a mixture of the silicone rubber serving as a binder and the abrasive grains 32*a*. The mixture having an abrasive grain ratio of 80% is diluted with toluene and sprayed to coat the core rod 31 to form the abrasive grain layer 32. In the first embodiment example, the viscosity of the mixture diluted with toluene, and the distance between a spray gun for spray coating and the surface of the core rod 31, and the diameter of a nozzle of the spray gun, are adjusted to form the following irregularities on the surface of the abrasive grain layer 32. That is, the ten-point mean roughness $Rz_{jis}$ and the mean length Rsm for specifying the roughness curve of the surface of the abrasive grain layer 32 are adjusted to respective "large" values defined in TABLE 2 given below.

TABLE 2

| | small | intermediate | large |
|---|---|---|---|
| ten-point mean roughness $Rz_{jis}$ (μm) | 20 to 39 | 40 to 59 | 60 to 79 |
| mean length Rsm (μm) | 35 to 59 | 60 to 84 | 85 to 109 |

In the present example, the ten-point mean roughness $Rz_{jis}$ and the mean length Rsm of the irregularities in the surface of the formed abrasive grain layer 32 were measured with a contact-type surface roughness meter, specifically Surfcorder SE-30H manufactured by Kosaka Laboratory Ltd., with a cut-off value of 2.5 mm.

Further, in the first embodiment example, the abrasive grain layer 32 has a density of $1.15\times10^{-3}$ g/mm$^3$, which was calculated as follows: The weight and the outer diameter of the core rod 31 were first measured before the formation of the abrasive grain layer 32, and then the weight and the outer diameter of the grinding roller 30 were measured after the formation of the abrasive grain layer 32. Then, the weight of the core rod 31 was subtracted from the weight of the grinding roller 30 to obtain the weight of the formed abrasive grain layer 32. Further, the outer diameter of the core rod 31 was subtracted from the outer diameter of the grinding roller 30, and the resultant difference was multiplied by the length of the grinding roller 30 excluding the lengths of the shafts of the grinding roller 30 to obtain the volume of the abrasive grain layer 32. Then, the weight of the abrasive grain layer 32 was divided by the volume of the abrasive grain layer 32 to obtain the density of the abrasive grain layer 32. In the first embodiment example, the thus-obtained density of the abrasive grain layer 32 is $1.15\times10^{-3}$ g/mm$^3$.

Further, a predetermined test image was continuously formed on A4-size printer sheets manufactured by Hammermill Paper Co. fed with the longitudinal direction of the sheets set parallel to the sheet feeding direction.

After the test image was formed on 10,000 sheets, a solid 100% cyan image was formed on an A3-size printer sheet fed before the execution of the grinding that takes place every 10,000 sheets. Then, the grinding was executed, and thereafter a solid 100% cyan image was again formed on another A3-size printer sheet. Herein, the grinding time was set to 3 minutes.

Then, the solid image obtained after the grinding was completed was compared with a limit sample to determine whether or not the solid image has a streak more noticeable than that of the limit sample. The limit sample is an A3-size solid 100% cyan image fixed by the fixing belt 21 corresponding to a ten-point mean roughness difference $\Delta Rz_{jis}$ of 0.2 μm illustrated in FIG. 11. That is, this step determines whether or not the grinding performance after the first grinding satisfies the above-described criterion.

Then, the glossiness of the solid image formed before the grinding and the solid image formed after the grinding were both measured with a Handy Glossmeter PG-1 glossmeter manufactured by Nippon Denshoku Industries Co., Ltd. Further, the ratio of the difference in glossiness between the two solid images to the glossiness of the solid image formed before the grinding was calculated as the reduction in image glossiness due to the first grinding. Then, it was determined whether or not the thus-calculated reduction in image glossiness exceeds an image glossiness reduction threshold of 5% illustrated in FIG. 11.

If the grinding performance and the reduction in image glossiness both satisfied the respective criteria after the first grinding, the evaluation was rated as acceptable.

Then, the test image was further formed on 90,000 A4-size printer sheets (i.e., the test image was formed on 100,000 A4-size printer sheets in total), and a solid 100% cyan image was formed on an A3-size printer sheet fed before the tenth grinding was executed in image forming apparatus 1. The tenth grinding was then executed with the grinding roller 30, and thereafter a solid 100% cyan image was again formed on another A3-size printer sheet. Then, the determination using the above-described limit sample and the determination based on the measurement of the glossiness were performed similarly to the first grinding. Thereafter, it was determined whether or not the grinding performance and the reduction in image glossiness both satisfied the respective criteria after the tenth grinding.

Then, the test image was further formed on 100,000 A4-size printer sheets (i.e., the test image was formed on 200,000 A4-size printer sheets in total), and a solid 100% cyan image was formed on an A3-size printer sheet fed before the twentieth grinding was executed in the image forming apparatus 1. The twentieth grinding was then executed with the grinding roller 30, and thereafter a solid 100% cyan image was again formed on another A3-size printer sheet. Then, determinations similar to those for the first and tenth grindings were made.

Then, the test image was further formed on 100,000 A4-size printer sheets (i.e., the test image was formed on 300,000 A4-size printer sheets in total), and a solid 100% cyan image was formed on an A3-size printer sheet fed before the thirtieth grinding was executed in the image forming apparatus 1. The thirtieth grinding was then executed with the grinding roller 30, and thereafter a solid 100% cyan image was again formed on another A3-size printer sheet. Then, determinations similar to those for the first, tenth, and twentieth grindings were made.

After the completion of the thirtieth grinding and the determinations thereof, the durability of the grinding roller 30 was evaluated as follows. That is, if the grinding performance and the reduction in image glossiness both satisfied the respective criteria after the tenth grinding but one of the grinding performance and the reduction in image glossiness failed to satisfy the corresponding criterion after the twentieth grinding, the durability of the grinding roller 30 was determined to be "unacceptable." Further, if the grinding performance and the reduction in image glossiness both satisfied the respective criteria after the twentieth grinding but one of the grinding performance and the reduction in image glossiness failed to satisfy the corresponding criterion after the thirtieth grinding, the durability of the grinding roller 30 was determined to be "acceptable." Further, if the grinding performance and the reduction in image glossiness both satisfied the respective criteria after the thirtieth grinding, the durability of the grinding roller 30 was determined to be "good."

Description will now be given of second to seventh embodiment examples and a comparative example. The second to seventh embodiment examples are similar to the first embodiment example except for the ten-point mean roughness $Rz_{jis}$ and the mean length Rsm of the abrasive grain layer 32.

According to the above-described definition in TABLE 2, the second embodiment example has a combination of an "intermediate" ten-point mean roughness $Rz_{jis}$ value and a "large" mean length Rsm value. The third embodiment example has a combination of an "intermediate" ten-point mean roughness $Rz_{jis}$ value and an "intermediate" mean length Rsm value. The fourth embodiment example has a combination of a "small" ten-point mean roughness $Rz_{jis}$ value and an "intermediate" mean length Rsm value. The fifth embodiment example has a combination of a "large" ten-point mean roughness $Rz_{jis}$ value and a "small" mean length Rsm value. The sixth embodiment example has a combination of an "intermediate" ten-point mean roughness $Rz_{jis}$ value and a "small" mean length Rsm value. The seventh embodiment example has a combination of a "small" ten-point mean roughness $Rz_{jis}$ value and a "small" mean length Rsm value. The comparative example is similar to the first to seventh embodiment examples except for the absence of the above-described irregularities on the surface of the abrasive grain layer of the grinding roller.

The determination of acceptability of the grinding performance and the reduction in image glossiness after the first grinding and the 3-grade evaluation (i.e., "unacceptable," "acceptable," or "good") of the durability of the grinding roller 30 were performed on each of the embodiment examples and the comparative example.

TABLE 3 summarizes the results of the determination of acceptability of the grinding performance and the reduction in image glossiness after the first grinding and the 3-grade evaluation of the durability of the grinding roller 30 performed on each of the embodiment examples and the comparative example.

TABLE 3

| | $Rz_{jis}$ | Rsm | grinding performance and reduction in image glossiness after first grinding | durability of grinding roller |
|---|---|---|---|---|
| embodiment example 1 | large | large | good | good |
| embodiment example 2 | inter-mediate | large | good | good |
| embodiment example 3 | inter-mediate | inter-mediate | good | good |
| embodiment example 4 | small | inter-mediate | good | good |
| embodiment example 5 | large | small | good | acceptable |
| embodiment example 6 | inter-mediate | small | good | acceptable |
| embodiment example 7 | small | small | good | acceptable |
| comparative example | no aggregates of abrasive grains | | good | unacceptable |

In TABLE 3, if the grinding performance and the reduction in image glossiness both satisfy the respective criteria after the first grinding, the evaluation is rated as "good." If one of the grinding performance and the reduction in image glossiness fails to satisfy the corresponding criterion after the first grinding, the evaluation is rated as "poor." The 3-grade evaluation of the durability of the grinding roller 30 is rated as "good," "acceptable," or "unacceptable," as described above.

As illustrated in TABLE 3, in the comparative example, the grinding performance and the reduction in image glossiness after the first grinding both satisfy the respective criteria and thus are determined to be acceptable, but the durability evaluation is rated as unacceptable. This is considered to be due to degradation of the grinding performance resulting from the above-described clogging.

Also in the first to seventh embodiment examples, the grinding performance and the reduction in image glossiness after the first grinding both satisfy the respective criteria and thus are determined to be acceptable. As to the durability, the first to fourth embodiment examples having a mean length Rsm of 60 μm or greater are determined to be good. The fifth to seventh embodiment examples having a mean length Rsm less than 60 μm, however, are determined to be acceptable. This is considered to be because a grinding roller having a mean length Rsm of 60 μm or greater is more effective in suppressing the clogging than a grinding roller having a mean length Rsm less than 60 μm.

In connection with the evaluation results of the first to seventh embodiment examples, the performance of a grinding roller having a mean length Rsm of 170 μm or greater was examined as follow. The grinding for diminishing streaks was first performed with a grinding roller having a mean length Rsm of 170 μm or greater. Then, a solid image formed after the grinding was compared with the above-described limit sample for sensory evaluation. Further, the grinding for diminishing streaks was performed with a grinding roller having a mean length Rsm of 160 μm or less. Then, a solid image formed after the grinding was subjected to similar sensory evaluation. In the sensory evaluation of the solid image corresponding to the grinding roller having a mean length Rsm of 170 μm or greater, unevenness in glossiness considered to be due to streaky grinding marks formed on a fixing belt was observed more than in the limit sample. Meanwhile, in the sensory evaluation of the solid image corresponding to the grinding roller having a mean length Rsm of 160 μm or less, such unevenness in glossiness was suppressed.

To manufacture a grinding roller having a mean length Rsm over 160 μm, it is necessary to increase the diameter of the particles sprayed in the spray coating to a value substantially equal to such a mean length Rsm. Such an increase in diameter of the sprayed particles results in unstable spraying, increasing the possibility of ejection of liquid columns or pulsation called breath. It has been confirmed that such ejection of liquid columns or pulsation makes it difficult to maintain the uniformity of the surface of the grinding roller.

Description will now be given of eighth to twenty-fifth embodiment examples. Prior to the preparation of the eighth to twenty-fifth embodiment examples, a scratch test was performed on each of four samples A to D of the grinding roller 30 in TABLE 4 given below.

TABLE 4

| | scratch abrasion mark depth (μm) | density ($g/mm^3$) |
|---|---|---|
| sample A | 21.8 | 0.00127 |
| sample B | 30.5 | 0.00114 |
| sample C | 43.9 | 0.00073 |
| sample D | 53.4 | 0.00054 |

Four samples A to D of the grinding roller 30 described above are similar to the grinding roller 30 according to the above-described first embodiment example except for the density of the abrasive grain layer 32. As described in TABLE 4, sample A has a density of $1.27\times10^{-3}$ $g/mm^3$, and sample B has a density of $1.14\times10^{-3}$ $g/mm^3$. Further, sample C has a density of $0.73\times10^{-3}$ $g/mm^3$, and sample D has a density of $0.54\times10^{-3}$ $g/mm^3$.

In the scratch test, a sapphire needle having a tip diameter of 0.5 mm is brought into contact with the surface of the abrasive grain layer 32 of each of samples A to D of the grinding roller 30 to place thereon a load of 0.98 N. The sapphire needle in this state is then slidingly reciprocated over a distance of 10 mm three times at a speed of 10 mm/sec. Then, a mark formed on the surface of the abrasive grain layer 32 of each of samples A to D of the grinding roller 30 (hereinafter referred to as scratch abrasion mark) as a result of the sliding reciprocation was measured in depth. Thereafter, more than ten grindings were executed with each of samples A to D of the grinding roller 30, and the number of grindings resulting in the crumbling of the projections 32*b* of the irregularities on the surface of the abrasive grain layer 32 was examined. The results thereof will be described below.

Figure 20:
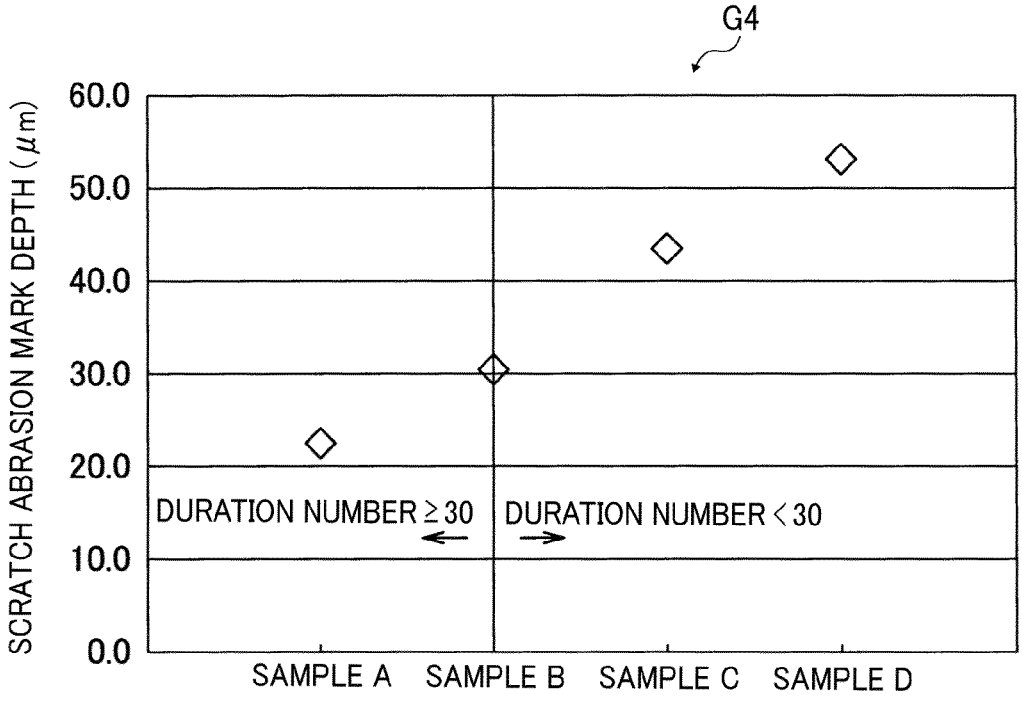
FIG. 20 is a graph illustrating the relationship between the depth of a scratch abrasion mark formed in a scratch test and the number of grindings causing crumbling of projections of the irregularities in the surface of the abrasive grain layer (i.e., duration number) for each of four samples.

FIG. 20 is a graph illustrating the relationship between the depth of the scratch abrasion mark formed in the scratch test and the number of grindings resulting in the crumbling of the projections 32*b* of the irregularities on the surface of the abrasive grain layer 32 (hereinafter referred to as duration number) for each of four samples A to D described in TABLE 4.

In graph G4 of FIG. 20, the horizontal axis represents the names of samples A to D, and the vertical axis represents the depth of the scratch abrasion mark. The respective depths of scratch abrasion marks of samples A to D are plotted with rhombuses. Herein, only sample A has a duration number of 30 or larger, and samples B to D have a duration number smaller than 30. Further, sample B having the highest density among samples B to D has a scratch abrasion mark depth of 30.5 μm.

In the embodiment examples, the desirable duration number for practical use is 30 or larger. Further, it is understood from samples A to D that the abrasive grain layer 32 having a duration number of 30 or larger has a scratch abrasion mark depth of roughly 30.0 μm or less.

The eighth to twenty-fifth embodiment examples were prepared to accurately determine the density of the abrasive grain layer 32 having the scratch abrasion mark depth of roughly 30.0 μm or less derived from samples A to D in TABLE 4 described above. The eighth to twenty-fifth embodiment examples are similar to the above-described first embodiment example except for the density of the abrasive grain layer 32. The above-described scratch test was performed on the respective abrasive grain layers 32 of the eighth to twenty-fifth embodiment examples to measure the depths of scratch abrasion marks formed on the abrasive grain layers 32. The densities of the abrasive grain layers 32 and the depths of the scratch abrasion marks corresponding to the eighth to twenty-fifth embodiment examples are summarized in FIG. 21 and TABLE 5 given below.

TABLE 5

| | scratch abrasion mark depth (μm) | density ($g/mm^3$) |
|---|---|---|
| embodiment example 8 | 21.8 | 0.00127 |
| embodiment example 9 | 30.5 | 0.00114 |
| embodiment example 10 | 17.5 | 0.00138 |
| embodiment example 11 | 33.5 | 0.00110 |
| embodiment example 12 | 25.0 | 0.00121 |
| embodiment example 13 | 15.9 | 0.00139 |
| embodiment example 14 | 20.3 | 0.00128 |
| embodiment example 15 | 16.8 | 0.00135 |
| embodiment example 16 | 14.7 | 0.00140 |
| embodiment example 17 | 15.0 | 0.00136 |
| embodiment example 18 | 18.3 | 0.00131 |
| embodiment example 19 | 19.7 | 0.00130 |
| embodiment example 20 | 17.3 | 0.00131 |
| embodiment example 21 | 20.4 | 0.00129 |
| embodiment example 22 | 17.1 | 0.00136 |
| embodiment example 23 | 16.4 | 0.00136 |
| embodiment example 24 | 17.3 | 0.00132 |
| embodiment example 25 | 17.1 | 0.00134 |

Figure 21:
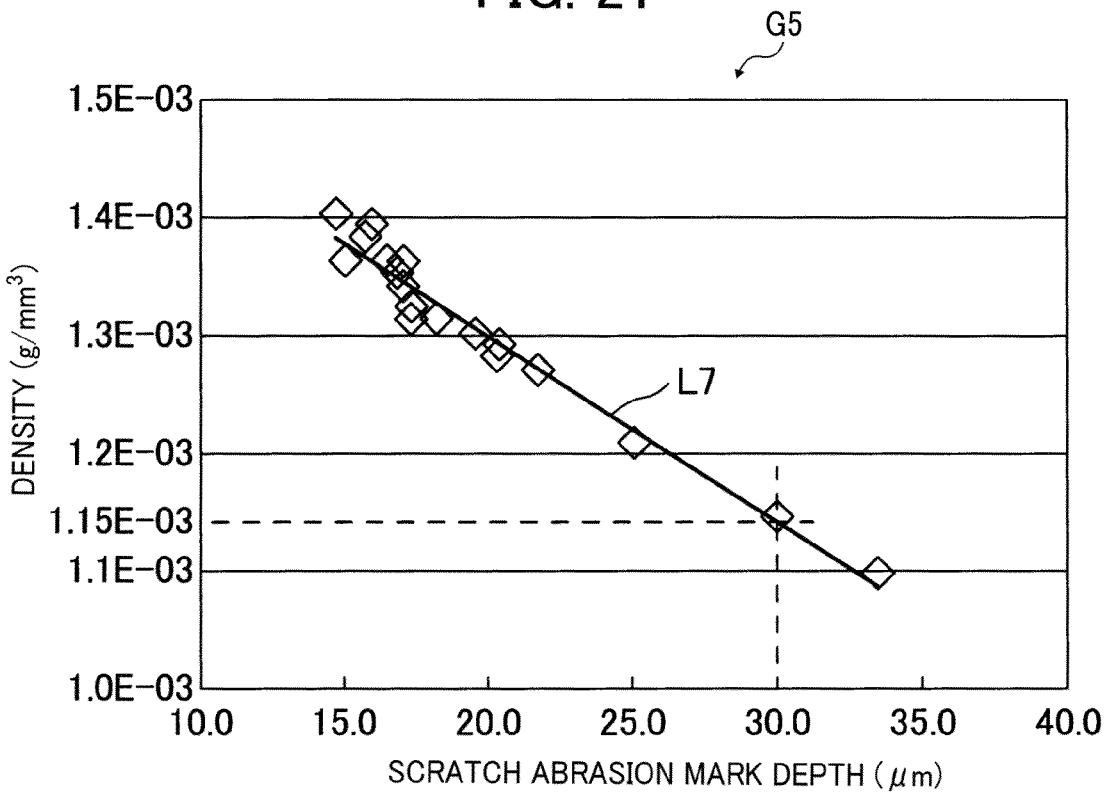
FIG. 21 is a graph plotting the densities of abrasive grain layers according to different embodiment examples and the depths of corresponding scratch abrasion marks.

FIG. 21 is a graph plotting the densities of the abrasive grain layers 32 and the depths of the scratch abrasion marks corresponding to the eighth to twenty-fifth embodiment examples. In graph G5 of FIG. 21, the horizontal axis represents the depth of the scratch abrasion mark, and the vertical axis represents the density of the abrasive grain layer 32. Further, in graph G5, the densities of the abrasive grain layers 32 corresponding to the depths of the scratch abrasion marks are plotted with rhombuses. As indicated by solid line L7 corresponding to the arrangement of the plots, it is understood that the density of the abrasive grain layer 32 is reduced with the increase in depth of the scratch abrasion mark. Further, on solid line L7, the density of the abrasive grain layer 32 corresponding to the scratch abrasion mark depth of 30.0 μm or less is $1.15\times10^{-3}$ $g/mm^3$ or higher. Accordingly, it is understood that the density of the abrasive grain layer 32 for attaining the duration number of 30 or larger, i.e., the desirable duration number for practical use, is $15\times10^{-3}$ $g/mm^3$ or higher.

Description will now be given of twenty-sixth to twenty-ninth embodiment examples. The twenty-sixth to twenty-ninth embodiment examples are similar to the above-described first embodiment example except for the type of the abrasive grains 32*a* of the abrasive grain layer 32. The abrasive grains 32*a* are silicon carbide-based abrasive grains in the twenty-sixth embodiment example, boron nitride-based abrasive grains in the twenty-seventh embodiment example, zirconia-based abrasive grains in the twenty-eighth embodiment example, and silica-based abrasive grains in the twenty-ninth embodiment example. The above-described scratch test was performed on each of five embodiment examples, i.e., four embodiment examples of the twenty-sixth to twenty-ninth embodiment examples and the first embodiment example employing white alumina abrasive grains (i.e., alumina-based abrasive grains) as the abrasive grains 32*a*, to measure the depths of scratch abrasion marks corresponding to the five embodiment examples.

Figure 22:
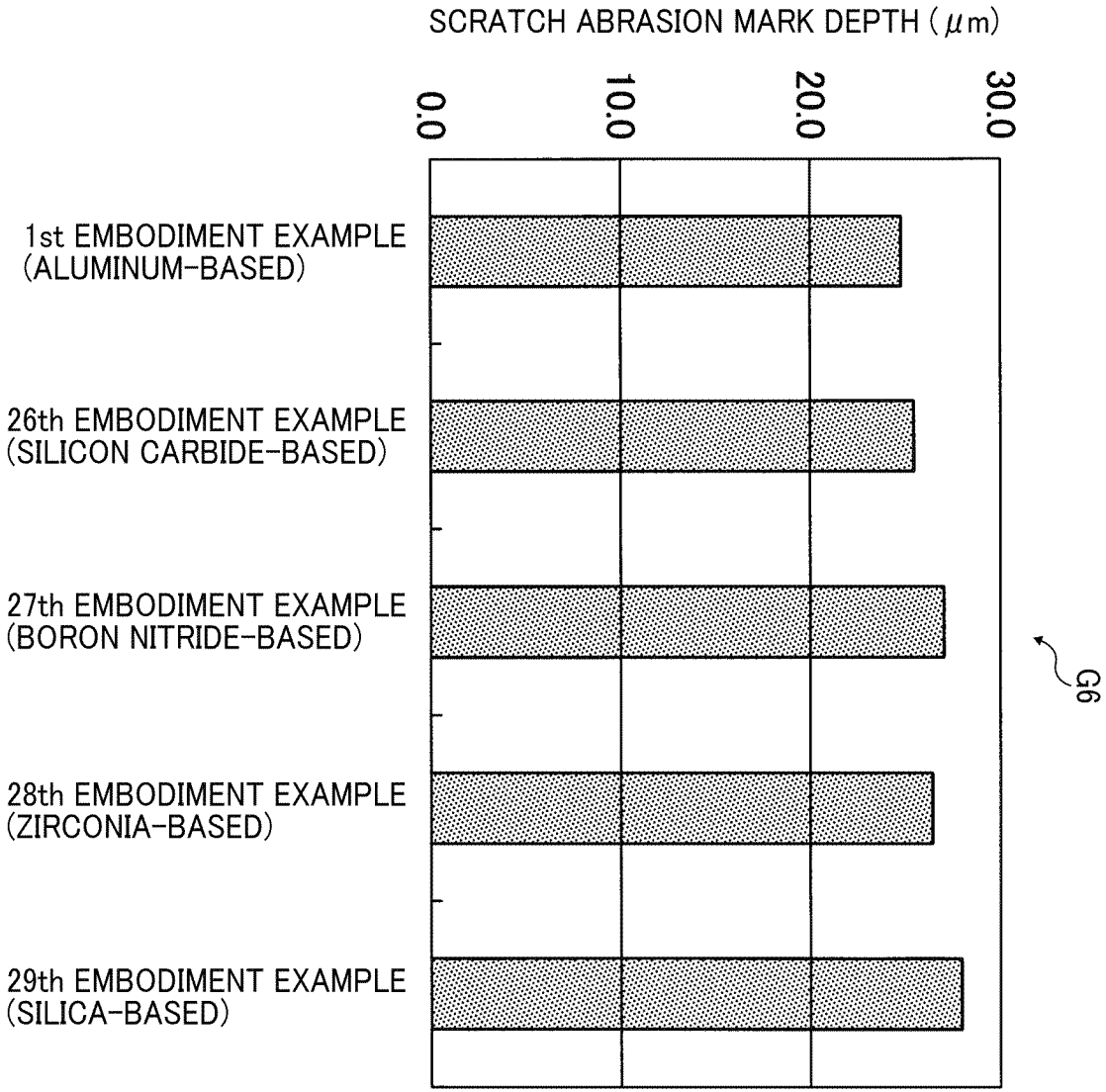
FIG. 22 is a bar graph of the depths of scratch abrasion marks corresponding to other embodiment examples.

FIG. 22 is a bar graph of the depths of the scratch abrasion marks corresponding to the first embodiment example and the twenty-sixth to twenty-ninth embodiment examples. In graph G6 of FIG. 22, the horizontal axis represents the names of the embodiment examples with the types of the abrasive grains 32*a*, and the vertical axis represents the depth of the scratch abrasion mark. It is understood from graph G6 that the above-described desirable duration number is obtained with a scratch abrasion mark depth of less than 30.0 μm irrespective of the type of the abrasive grains 32*a*, i.e., alumina-based, silicon carbide-based, boron nitride-based, zirconia-based, or silica-based.

A grinding roller, a fixing device, and an image forming apparatus according to embodiments of the present invention are capable of reducing the grinding time while suppressing a reduction in glossiness of a surface of a toner image-side rotary member.

What is claimed is:

1. A grinding roller for use in a fixing device including a pair of rotary fixing members that rotate while being pressed against each other to form an area of contact, and heat and press a recording medium carrying an unfixed toner image and fed to the area of contact, to thereby fix the unfixed toner image on the recording medium, the grinding roller configured to grind a surface of a toner image-side rotary member of the pair of rotary fixing members that comes into contact with the unfixed toner image, the grinding roller comprising:

an abrasive grain layer including abrasive grains, forming a surface layer of the grinding roller, and having a surface with irregularities including projections and recesses formed between the projections, each projection formed by an aggregate of some of the abrasive grains and larger in size than each of the abrasive grains, wherein each of the irregularities is greater than each of the abrasive grains in at least one of ten-point mean roughness $Rz_{jis}$ and mean length Rsm specifying a roughness curve of the surface of the abrasive grain layer, and wherein the mean length Rsm of each of the irregularities is greater than the size of each of the abrasive grains, and ranges from 60 μm to 160 μm.

2. The grinding roller according to claim 1, wherein the abrasive grain layer is a mixture of the abrasive grains and a resin, and a weight ratio of the abrasive grains to the mixture is 65% or higher.

3. The grinding roller according to claim 1, wherein the abrasive grain layer is a mixture of the abrasive grains and a resin, and the abrasive grain layer has a density of $1.15\times10^{-3}$ $g/mm^3$ or higher.

4. The grinding roller according to claim 1, wherein the abrasive grains have a mean particle diameter of 9 μm or less at 50% point of cumulative height.

5. The grinding roller according to claim 1, wherein the abrasive grains included in the abrasive grain layer are at least one of alumina-based abrasive grains, silicon carbide-based abrasive grains, boron nitride-based abrasive grains, zirconia-based abrasive grains, and silica-based abrasive grains.

6. A fixing device comprising:

a pair of rotary fixing members configured to rotate while being pressed against each other to form an area of contact, and heat and press a recording medium carrying an unfixed toner image and fed to the area of contact, to thereby fix the unfixed toner image on the recording medium; and a grinding roller configured to grind a surface of a toner image-side rotary member of the pair of rotary fixing members that comes into contact with the unfixed toner image, wherein the grinding roller includes an abrasive grain layer including abrasive grains, forming a surface layer of the grinding roller, and having a surface with irregularities including projections and recesses formed between the projections, each projection formed by an aggregate of some of the abrasive grains and larger in size than each of the abrasive grains, wherein each of the irregularities is greater than each of the abrasive grains in at least one of ten-point mean roughness $Rz_{jis}$ and mean length Rsm specifying a roughness curve of the surface of the abrasive grain layer, and wherein the mean length Rsm of each of the irregularities is greater than the size of each of the abrasive grains, and ranges from 60 μm to 160 μm.

7. An image forming apparatus comprising:

an image forming unit configured to form an unfixed toner image on a recording medium; and a fixing device comprising:

a pair of rotary fixing members configured to rotate while being pressed against each other to form an area of contact, and heat and press the recording medium carrying the unfixed toner image and fed to the area of contact, to thereby fix the unfixed toner image on the recording medium, and a grinding roller configured to grind a surface of a toner image-side rotary member of the pair of rotary fixing members that comes into contact with the unfixed toner image, wherein the grinding roller includes an abrasive grain layer including abrasive grains, forming a surface layer of the grinding roller, and having a surface with irregularities including projections and recesses formed between the projections, each projection formed by an aggregate of some of the abrasive grains and larger in size than each of the abrasive grains, wherein each of the irregularities is greater than each of the abrasive grains in at least one of ten-point mean roughness $Rz_{jis}$ and mean length Rsm specifying a roughness curve of the surface of the abrasive grain laver, and wherein the mean length Rsm of each of the irregularities is greater than the size of each of the abrasive grains, and ranges from 60 μm to 160 μm.

* * * * *